US011560826B2

(12) United States Patent
Hamamoto et al.

(10) Patent No.: US 11,560,826 B2
(45) Date of Patent: Jan. 24, 2023

(54) WORKING MACHINE

(71) Applicant: KUBOTA CORPORATION, Osaka (JP)

(72) Inventors: Ryota Hamamoto, Osaka (JP); Taketo Kimura, Osaka (JP); Satoshi Takaki, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/394,941

(22) Filed: Aug. 5, 2021

(65) Prior Publication Data

US 2022/0049641 A1 Feb. 17, 2022

(30) Foreign Application Priority Data

Aug. 15, 2020 (JP) ..... JP2020-137189
Aug. 15, 2020 (JP) ..... JP2020-137190
Aug. 15, 2020 (JP) ..... JP2020-137191

(51) Int. Cl.

*F01P 5/02* (2006.01)
*F01P 3/18* (2006.01)
*F01P 5/04* (2006.01)
*F01P 11/14* (2006.01)

(52) U.S. Cl.

CPC ..... *F01P 5/043* (2013.01); *F01P 3/18* (2013.01); *F01P 11/14* (2013.01); *F01P 2025/40* (2013.01); *F01P 2025/50* (2013.01); *F01P 2037/00* (2013.01); *F01P 2060/14* (2013.01)

(58) Field of Classification Search

CPC ... B60K 11/06; F01P 5/02; F01P 11/10; F04D 25/166; F04D 19/002

See application file for complete search history.

(56) References Cited

U.S. PATENT DOCUMENTS 5,660,149 A * 8/1997 Lakerdas ..... F01P 5/06 123/41.01
5,771,961 A * 6/1998 Alizadeh ..... F04D 29/582 165/41
2003/0183433 A1* 10/2003 MacKelvie ..... F04D 19/005 180/68.1
2007/0209612 A1* 9/2007 Kojima ..... F02N 11/0818 123/179.4
2012/0057989 A1* 3/2012 Cho ..... F01P 5/043 417/46

(Continued)

FOREIGN PATENT DOCUMENTS

JP 2001-182535 A 7/2001
JP 2009-092046 A 4/2009

*Primary Examiner* — Long T Tran

(74) *Attorney, Agent, or Firm* — Greenblum & Bernstein, P.L.C.

(57) ABSTRACT

A working machine includes a machine body, an engine provided on the machine body, a radiator to cool a coolant supplied to the engine, a first fan provided on one directional surface side of the radiator, the first fan being rotatable in either one of a first direction to suck external air to an interior of the machine body and a second direction to generate an air flow for discharging air from the interior of the machine body to an exterior of the machine body, and a second fan provided on the other directional surface side of the radiator and configured to be rotated in the second direction.

17 Claims, 13 Drawing Sheets

(56) References Cited

U.S. PATENT DOCUMENTS

| | | | | |
|---|---|---|---|---|
| 2013/0146377 | A1* | 6/2013 | Adamson | B60K 11/06 180/68.1 |
| 2013/0153180 | A1* | 6/2013 | Montocchio | B60K 11/04 165/121 |
| 2016/0047609 | A1* | 2/2016 | Gauthier | B60H 3/0633 165/303 |
| 2016/0281328 | A1* | 9/2016 | Hino | B62D 55/06 |

* cited by examiner

WORKING MACHINE

CROSS-REFERENCE TO RELATED APPLICATION

This application claims the benefit of priorities to Japanese Patent Application No. 2020-137189 filed on Aug. 15, 2020, Japanese Patent Application No. 2020-137190 filed on Aug. 15, 2020, and Japanese Patent Application No. 2020-137191 filed on Aug. 15, 2020. The entire contents of this application are hereby incorporated herein by reference.

BACKGROUND OF THE INVENTION

Field of the Invention

The present invention relates to a working machine such as a skid steer loader or a compact track loader.

Description of the Related Art

A working machine disclosed in Japanese Patent Publication No. 2009-92046 (referred to as Patent Document 1) is already known.

The working machine disclosed in Patent Document 1 is provided with a cooling fan for cooling a radiator and the like, and a switching mechanism for switching a rotational direction of the cooling fan between a normal direction and a reverse direction.

In addition, a working machine disclosed in Japanese Patent Publication No. 2001-182535 (referred to as Patent Document 2) is already known.

The working machine disclosed in Patent Document 2 has a cooling fan for cooling a radiator and the like, and a controller for controlling switching of a rotational direction of the cooling fan between a normal direction and a reverse direction.

BRIEF SUMMARY OF THE INVENTION

In the working machine disclosed in Patent Document 1, the radiator and the like can be cooled by rotating the cooling fan in the normal direction, and dusts on the radiator and the like can be blown away by rotating the cooling fan in the reverse direction. However, simply rotating the cooling fan in the reverse direction may not provide a sufficient air capacity to blow away the dusts. For example, the cooling fan has an insufficient air capacity at the central portion thereof and its vicinity. Thus, even when the cooling fan is rotated in the reverse direction, the unblown dusts are accumulated to deteriorate a cooling performance.

In addition, when the cooling fan is rotated in the reverse direction for a long period of time, a negative pressure (that is, a suction pressure) may be generated on a hood from which the wind blows out, and thus it may be impossible to blow off the dusts.

In the working machine disclosed in Patent Document 2, the radiator and the like can be cooled by rotating the cooling fan in the normal direction, and the dusts on the radiator and the like can be blown away by rotating the cooling fan in the reverse direction. However, the reverse rotation cannot be stopped even in a case some abnormality occurred while the cooling fan rotates in the reverse direction.

In view of the above-mentioned problems, the present invention intends to provide a working machine including a fan having a sufficient air capacity for blowing off the dusts.

In addition, the present invention intends to provide a working machine including a fan capable of blowing off the dusts reliably for a long time.

In addition, the present invention intends to provide a working machine including a fan allowed to stop its rotation as needed when the fan is rotated in the reverse direction.

A working machine according to one aspect of the present invention includes a machine body, an engine provided on the machine body, a radiator to cool a coolant supplied to the engine, a first fan provided on one directional surface side of the radiator, the first fan being rotatable in either one of a first direction to suck external air to an interior of the machine body and a second direction to generate an air flow for discharging air from the interior of the machine body to an exterior of the machine body, and a second fan provided on the other directional surface side of the radiator and configured to be rotated in the second direction.

The working machine further includes a controller to control drive of the first and second fans. The controller is configured or programmed to stop the second fan when the first fan rotates in the first direction, and to drive the second fan when the first fan rotates in the second direction.

The working machine further includes a condenser to condense a refrigerant for an air conditioner provided on the machine body. The condenser is provided between the radiator and the second fan.

The air capacity of the first fan rotating in the first direction is larger than that of the first fan rotating in the second direction.

The first fan and the second fan have respective rotary axes coaxial to each other.

The second fan is diametrically smaller than the first fan.

The first fan is a hydraulic fan driven by hydraulic pressure. The second fan is an electric fan driven by electricity.

The working machine further includes a fan cover to cover an upper side of the second fan opposite to the condenser. The second fan is provided on a lower side thereof with a blade, and on an upper side thereof with a motor for rotating the blade. An upper surface of the fan includes a flat surface and an uneven surface. The flat surface overlaps the motor in plan view.

A working machine according to one aspect of the present invention includes a machine body, an engine provided on the machine body, a radiator to cool a coolant supplied to the engine, a first fan provided on one directional surface side of the radiator, the first fan being rotatable in either one of a first direction to suck external air to an interior of the machine body and a second direction to generate an air flow for discharging air from the interior of the machine body to an exterior of the machine body, and a controller to control drive of the first fan. The controller is configured or programmed to control drive of the first fan rotating in the second direction in such a way that a process of actions including a speed-increasing action to increase a rotation speed of the first fan and a speed-reducing action to reduce the rotation speed of the first fan increased by the speed-increasing action is repeated in a predetermined period.

The controller is configured or programmed to increase the rotation speed of the first fan rotating in the second direction to a maximum rotation speed during the speed-increasing action, and to reduce the rotation speed of the first fan rotating in the second direction to a minimum rotation speed during the speed-reducing action.

The controller is configured or programmed to control drive of the first fan rotating in the second direction during the process of actions in such a way that a time for the rotation of the first fan at the maximum rotation speed is longer than a time for the rotation of the first fan at the minimum rotation speed.

The controller is configured or programmed to control drive of the first fan rotating in the second direction during the process of actions in such a way that a time for the rotation of the first fan at the minimum rotation speed is longer than a time for the rotation of the first fan at the maximum rotation speed.

The working machine further includes a second fan provided on the other directional surface side of the radiator and configured to be rotated in the second direction. The controller is configured or programed to drive the second fan continuously during the predetermined period of repeating the process of actions.

The controller is configured or programed to perform a first switching action to switch the rotation direction of the first fan from the first direction to the second direction before start of repeating the process of actions, and to perform a second switching action to switch the rotation direction of the first fan from the second direction to the first direction after end of repeating the process of actions.

The controller is configured or programed to perform the first switching action and the second switching action when the first fan rotates at the minimum rotation speed.

The controller is configured or programed to start drive of the second fan at a time shifted from that of performing the first switching action.

The controller is configured or programed to start drive of the second fan before performing the first switching action.

The controller is configured or programed to stop drive of the second fan at a time shifted from that of performing the second switching action.

The controller is configured or programed to stop drive of the second fan after performing the second switching action.

A working machine according to one aspect of the present invention includes a machine body, an engine provided on the machine body, a radiator to cool a coolant supplied to the engine, a fan provided on one directional surface side of the radiator, the first fan being rotatable in either one of a first direction to suck external air to an interior of the machine body and a second direction to generate an air flow for discharging air from the interior of the machine body to an exterior of the machine body, and a controller to control drive of the fan. The controller is configured or programmed to make the fan selectively perform either a basic action to finish the rotation of the fan in the second direction after a predetermined period elapses from start of the rotation of the fan in the second direction or a canceling action to interrupt the rotation of the fan in the second direction when an interruption condition is satisfied in the predetermined period.

The controller is configured or programed to make the fan perform the canceling action in such a way that the rotation direction of the fan is switched to the first direction after the rotation speed of the fan rotating in the second direction is gradually reduced.

The controller is configured or programed to make the fan perform the canceling action in such a way that the rotation of the fan is stopped after the rotation speed of the fan rotating in the second direction is gradually reduced.

The controller is configured or programed to make the fan perform the canceling action in such a way that the rotation of the fan is stopped after a predetermined period elapses since the reduced rotation speed of the fan rotating in the second direction becomes a minimum rotation speed.

The working machine further includes a working device attached to the machine body, a first sensor to detect a temperature of operation fluid for driving the working device, and a second sensor to detect a temperature of the coolant for cooling the engine. The controller is configured or programed to define a state where the temperature detected by the first sensor or the second sensor deviates from a predetermined temperature range as the satisfied interruption condition for determination to perform the canceling action.

The controller is configured or programmed to define stopping of the engine as the satisfied interruption condition for determination to perform the canceling action.

The working machine further includes a switch manually operable to be shifted between an ON state to allow the fan to rotate in the second direction and an OFF state to hinder the fan from rotating in the second direction. The controller is configured or programmed to define the setting of the switch in the OFF state as the satisfied interruption condition for determination to perform the canceling action.

The working machine further includes a detector to detect a fault of a component relevant to the drive of the fan. The controller is configured or programmed to define a state where a fault is detected by the detector as the satisfied interruption condition for determination to perform the canceling action.

The working machine further includes an exhaust gas purificator including a filter to trap particulate matters included in exhaust gas from the engine, and a filter regenerator to burn the particulate matters trapped by the filter. The controller is configured or programed to define a state where the filter regenerator performs a filter regeneration process to burn the particulate matters as the satisfied interruption condition for determination to perform the canceling action.

The working machine further includes a setting member to set a rotation speed of the engine, and a rotation speed sensor to detect the rotation speed of the engine. The controller is configured or programed to define a state where a differential value obtained by subtracting an actual rotation speed detected by the rotation speed sensor from an instructed rotation speed set by the setting member as the satisfied interruption condition for determination to perform the canceling action.

The working machine further includes a working device attached to the machine body, a first sensor to detect a temperature of operation fluid for driving the working device, a second sensor to detect a temperature of the coolant for cooling the engine, and a fault detector to detect a fault of the first sensor or the second sensor. The controller is configured or programed to define a state where a fault is detected by the fault detector as the satisfied interruption condition for determination to perform the canceling action.

The working machine further includes a cabin mounted on the machine body, and an air conditioner to feed a temperature-adjusted air into the cabin. The controller is configured or programed to define a state where the air conditioner is driven as the satisfied interruption condition for determination to perform the canceling action.

Due to the working machine, the air capacity generated by the rotation of the second fan can compensate for an insufficient air capacity provided by the rotation of the first fan alone (for example, the insufficient air capacity of the first fan at the central portion thereof and its vicinity), so that a sufficient air capacity can be obtained for blowing dusts toward the outside of the machine body.

Due to the working machine, by repeating the increase and decrease of the number of rotations while the first fan is rotating in the second direction, a negative pressure (that is, a suction pressure) can be prevented from being generated in a portion from which the wind of the first fan blows out. Thus, the dusts can be blown away reliably for a long time.

Due to the working machine, while the fan for cooling is rotating in the reverse direction (that is, a second direction) opposite to the direction for cooling, the rotation in the reverse direction can be stopped as needed. In this manner, problems (such as overheating of the equipment) that may occur due to continuous rotation of the fan in the reverse direction can be eliminated.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

FIG. 1 is a side cross-sectional view of a rear portion of a working machine, which shows a first fan, a second fan, a radiator, a condenser, a fan cover, and the like.

FIG. 2 is a front cross-sectional view of the rear portion of the working machine, which shows the first fan, the second fan, the radiator, the condenser, the fan cover, and the like.

DETAILED DESCRIPTION OF THE PREFERRED EMBODIMENTS

Figure 1:
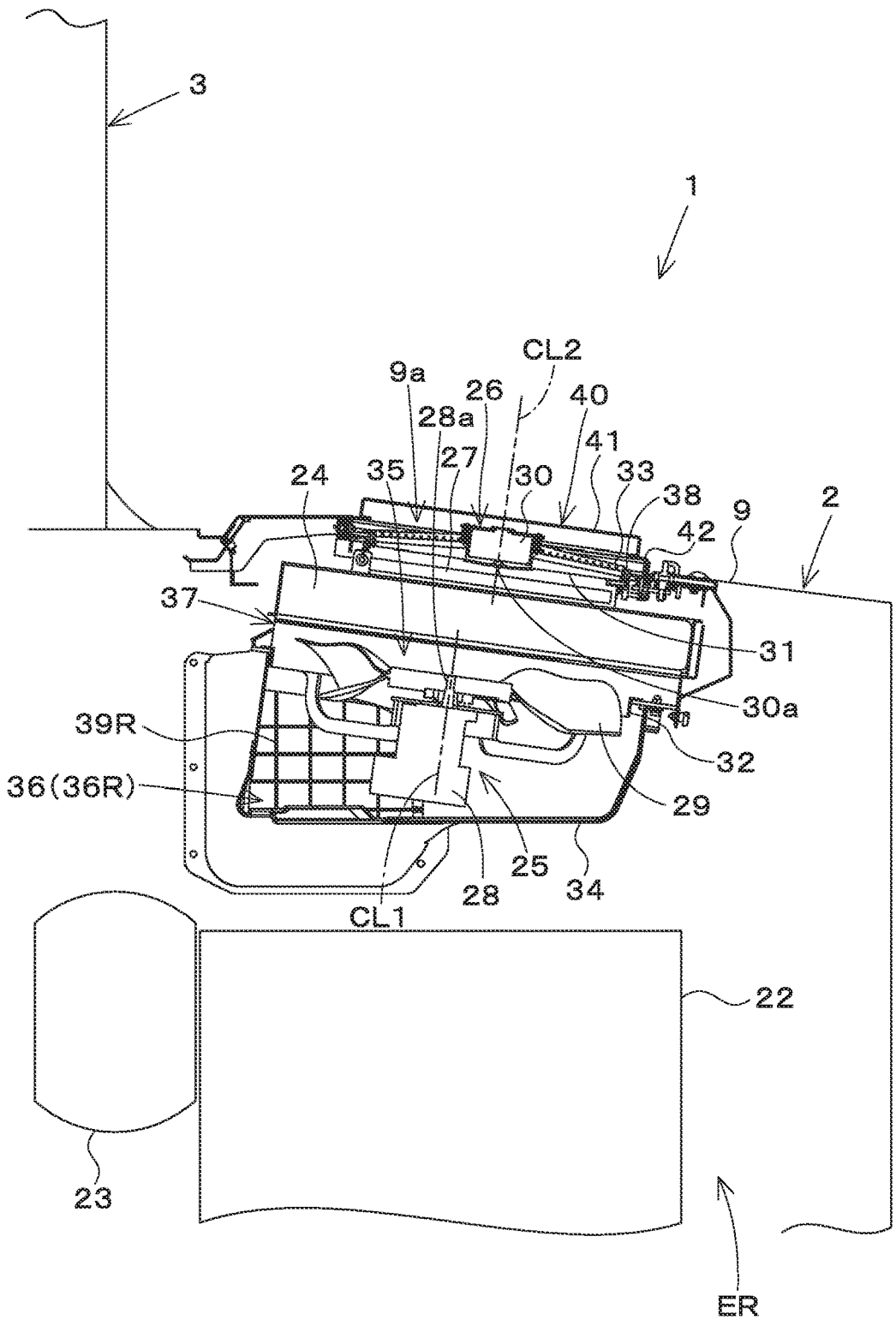

The preferred embodiments will now be described with reference to the accompanying drawings, wherein like reference numerals designate corresponding or identical elements throughout the various drawings. The drawings are to be viewed in an orientation in which the reference numerals are viewed correctly.

A working machine according to a preferred embodiment of the present invention will be described below.

Figure 12:
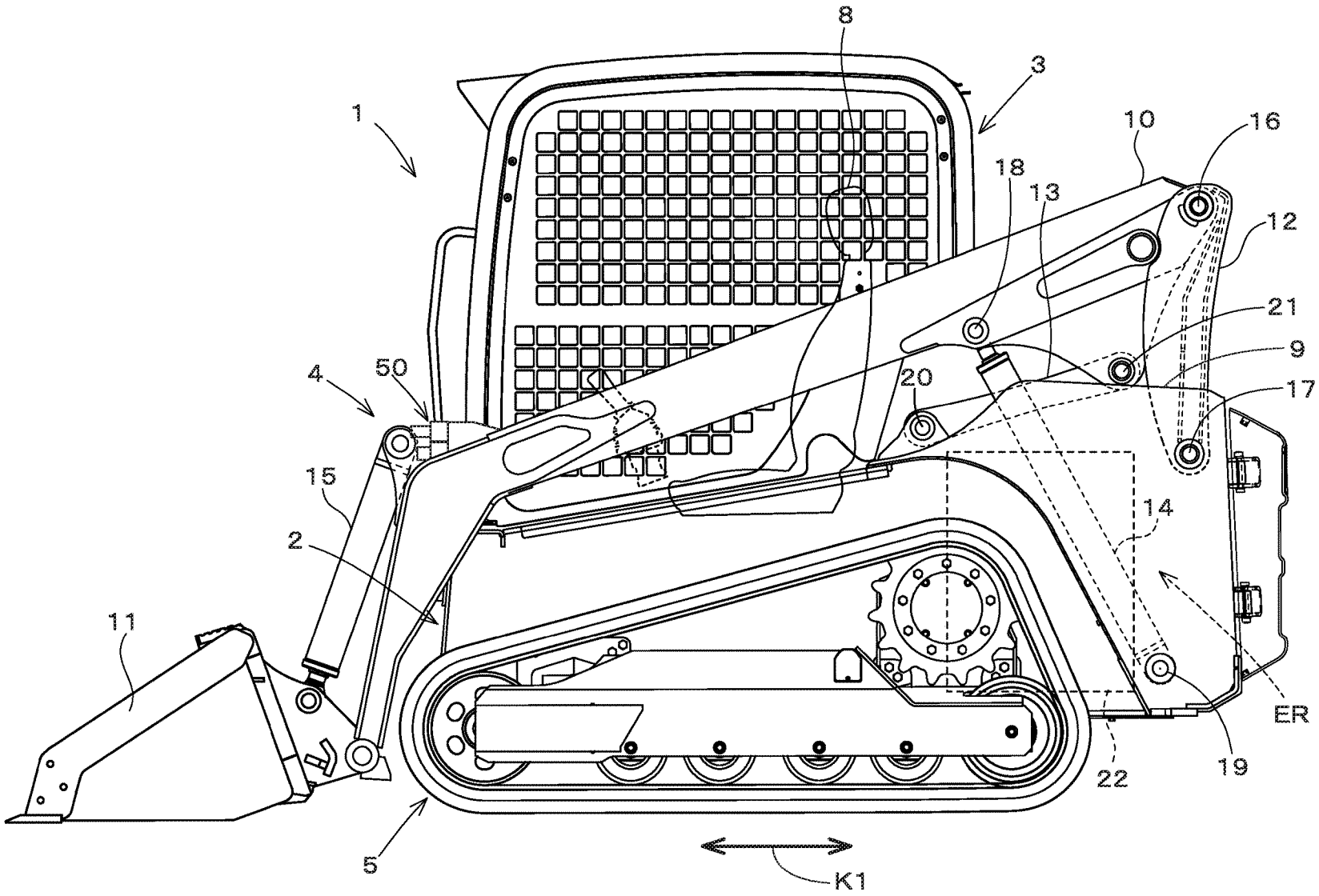
FIG. 12 is a side view showing a track loader that is an example of the working machine.

FIG. 12 shows a side view of the working machine according to the present invention. In FIG. 12, a compact track loader is shown as an example of the working machine. However, the working machine according to the present invention is not limited to the compact track loader, but may be another typed loader, such as a skid steer loader, for example. In addition, the working machine may be one other than the loader.

As shown in FIG. 12, the working machine 1 includes a machine body 2, a cabin 3, a working device 4, and traveling devices 5. In the embodiment of the present invention, a forward direction of a driver sitting on a driver seat 8 of the working machine 1 (a left side in FIG. 12) is referred to as the front, a rearward direction of the driver (a right side in FIG. 12) is referred to as the rear, a leftward direction of the driver (a front surface side of FIG. 12) is referred to as the left, and a rightward direction of the driver (a back surface side of FIG. 12) is referred to as the right. In addition, a horizontal direction, which is orthogonal to a fore-and-aft direction K1, is referred to as a machine-width direction K2.

The cabin 3 is mounted on the machine body 2. The cabin 3 incorporates the driver seat 8. The working machine 1 is provided with an air conditioner (not shown in the drawings) configured to supply temperature-conditioned air into the cabin 3. An operation of the air conditioner is controlled by a controller 60 to be described later. The traveling devices 5 are provided respectively on the left and right sides of the machine body 2. In the present embodiment, a crawler-type (including a semi-crawler type) traveling device is adopted as each of the traveling devices 5. However, a wheel-type traveling device having front wheels and rear wheels may be adopted.

The working device 4 is attached to the machine body 2. The working device 4 includes booms 10, a working tool 11, lift links 12, control links 13, boom cylinders 14, and bucket cylinders 15. The boom cylinders 14 and the bucket cylinders 15 are hydraulic cylinders, and are driven (telescoped) by operation fluid supplied from a hydraulic pump.

The booms 10 are vertically swingably arranged on right and left sides of the cabin 3. The working tool 11 is a bucket, for example. The bucket 11 is vertically movably arranged on tip portions (that is, front end portions) of the booms 10. The lift links 12 and the control links 13 support base portions (that is, rear portions) of the booms 10 so as to allow the booms 10 to swing up and down. The booms 10 are raised and lowered by telescoping the boom cylinders 14. The bucket 11 is swung by telescoping the bucket cylinders 15.

Front portions of the right and left booms 10 are connected to each other by a deformed connecting pipe. Base portions (that is, rear portions) of the booms 10 are connected to each other by a circular connecting pipe.

The lift links 12, the control links 13, and the boom cylinders 14 are arranged on right and left sides of the machine body 2 distributedly in correspondence to the right and left booms 10.

The lift links 12 are extended vertically from rear portions of the base portions of the booms 10. Upper portions (one end portions) of the lift links 12 are pivoted on the rear portions of the base portions of the booms 10 pivotally supported on the rear portions of the base portions of the booms 10 via respective pivot shafts (referred to as first pivot shafts) 16 turnably around lateral axes defined by the pivot shafts 16. Lower portions (the other end portions) of the lift links 12 are pivotally supported on the rear portion of the machine body 2 via respective pivot shafts (referred to as second pivot shafts) 17 turnably around lateral axes defined by the pivot shafts 17. The second pivot shafts 17 are provided below the first pivot shafts 16.

Upper portions of the boom cylinders 14 are pivotally supported on respective pivot shafts (referred to as third pivot shafts) 18 turnably around lateral axes defined by the pivot shafts 18. The third pivot shafts 18 are provided at the base portions of the booms 10, especially, at front portions of the base portions. Lower portions of the boom cylinders 14 are pivotally supported on respective pivot shafts (referred to as fourth pivot shafts) 19 turnably around lateral axes defined by pivot shafts 19. The fourth pivot shafts 19 are provided at a lower portion of the rear portion of the machine body 2 and below the third pivot shafts 18.

The control links 13 are provided in front of the lift links 12. One ends of the control links 13 are pivotally supported on respective pivot shafts (referred to as fifth pivot shafts) 20 turnably around lateral axes defined by the pivot shafts 20. In the machine body 2, the fifth pivot shafts 20 are disposed forward from the lift links 12. The other ends of the control links 13 are pivotally supported on respective pivot shafts (referred to as sixth pivot shafts) 21 turnably around lateral axes defined by the pivot shafts 21. In the working machine 2, the sixth pivot shafts 21 are disposed forwardly upward from the second pivot shafts 17.

By telescoping the boom cylinders 14, the booms 10 are swung up and down around the first pivot shafts 16 with the base portions of the booms 10 supported by the lift links 12 and the control links 13, thereby raising and lowering the tip portions of the booms 10. The control links 13 are swung up and down around the fifth pivot shafts 20 by the vertical swinging of the booms 10. The lift links 12 are swung back and forth around the second pivot shafts 17 by the vertical swinging of the control links 13.

An alternative working tool instead of the bucket 11 can be attached to the front portions of the booms 10. For example, an attachment (specifically, an auxiliary attachment), such as a hydraulic crusher, a hydraulic breaker, an angle broom, an earth auger, a pallet fork, a sweeper, a mower, or a snow blower, may serve as the alternative working tool.

A connecting member 50 is provided at the front portion of the left boom 10. The connecting member 50 is a device configured to connect a hydraulic equipment attached to the auxiliary attachment to a first piping member such as a pipe provided on the left boom 10. Specifically, the first piping member can be connected to one end of the connecting member 50, and a second piping member connected to the hydraulic equipment of the auxiliary attachment can be connected to the other end. In this manner, an operation fluid flowing in the first piping member is passed through the second piping member and is supplied to the hydraulic equipment.

The bucket cylinders 15 are arranged close to the front portions of the booms 10, respectively. The bucket 11 is swung by telescoping the bucket cylinders 15.

As shown in FIG. 1, a prime mover 22 is mounted in a rear inside portion of the machine body 2. An engine (specifically, an internal combustion engine), such as a diesel engine or a gasoline engine, an electric motor, or the like may serve as the prime mover 22. In the embodiment, the prime mover 22 is an engine, specifically, a diesel engine. In the following description, the prime mover 22 is referred to as the engine 22. In addition, a space inside the machine body 2 in which the engine 22 is mounted (housed) is referred to as an engine room ER. The engine room ER is covered by the hood 9 from above.

An exhaust gas purification device 23 provided with a filter (Diesel Particulate Filter: DPF) that collects particulate matters contained in the exhaust gas from the engine 22 is arranged in the engine room ER. The working machine 1 is provided with a filter regenerator (not shown in the drawings) that burns particulate matters trapped and collected in the filter of the exhaust gas purification device 23. The filter regenerator performs a filter regeneration (DPF regeneration) processing based on control by the controller 60 to be described below. The filter regeneration process is carried out by raising a temperature of the DPF to or above a predetermined temperature, thereby burning off accumulated PM to gasify it, and discharging the gas to the environment along with the exhaust gas. The DPF regeneration is carried out, for example, by post-injection of fuel. The post-injection is an operation to facilitate the temperature rising of the DPF by injecting fuel into the gas after the combustion.

As shown in FIG. 1, a radiator 24 is arranged above the engine 22. The radiator 24 cools a coolant supplied to the engine 22. The radiator 24 is arranged, so that one side faces downward and the other side faces upward. The radiator 24 is arranged slantwise downwardly from the front to the rear.

A first fan 25 is arranged above the engine 22 and below the radiator 24. The first fan 25 is arranged on one directional surface side (that is, a lower surface side) of the radiator 24. In the present embodiment, the first fan 25 is a hydraulic fan configured to be driven by a hydraulic pressure. The first fan 25 is driven by a first motor 28. The first motor 28 is a hydraulic motor configured to be operated by operation fluid. An output shaft of the first motor 28 (hereinafter referred to as "the first output shaft 28*a*") extends upward (that is, diagonally upward and backward). A first blade 29 is attached to an upper portion of the first output shaft 28*a*. That is, in the first fan 25, the first blade 29 is arranged on the upper side, and the first motor 28 for rotating the first blade 29 is arranged on the lower side.

Figure 2:
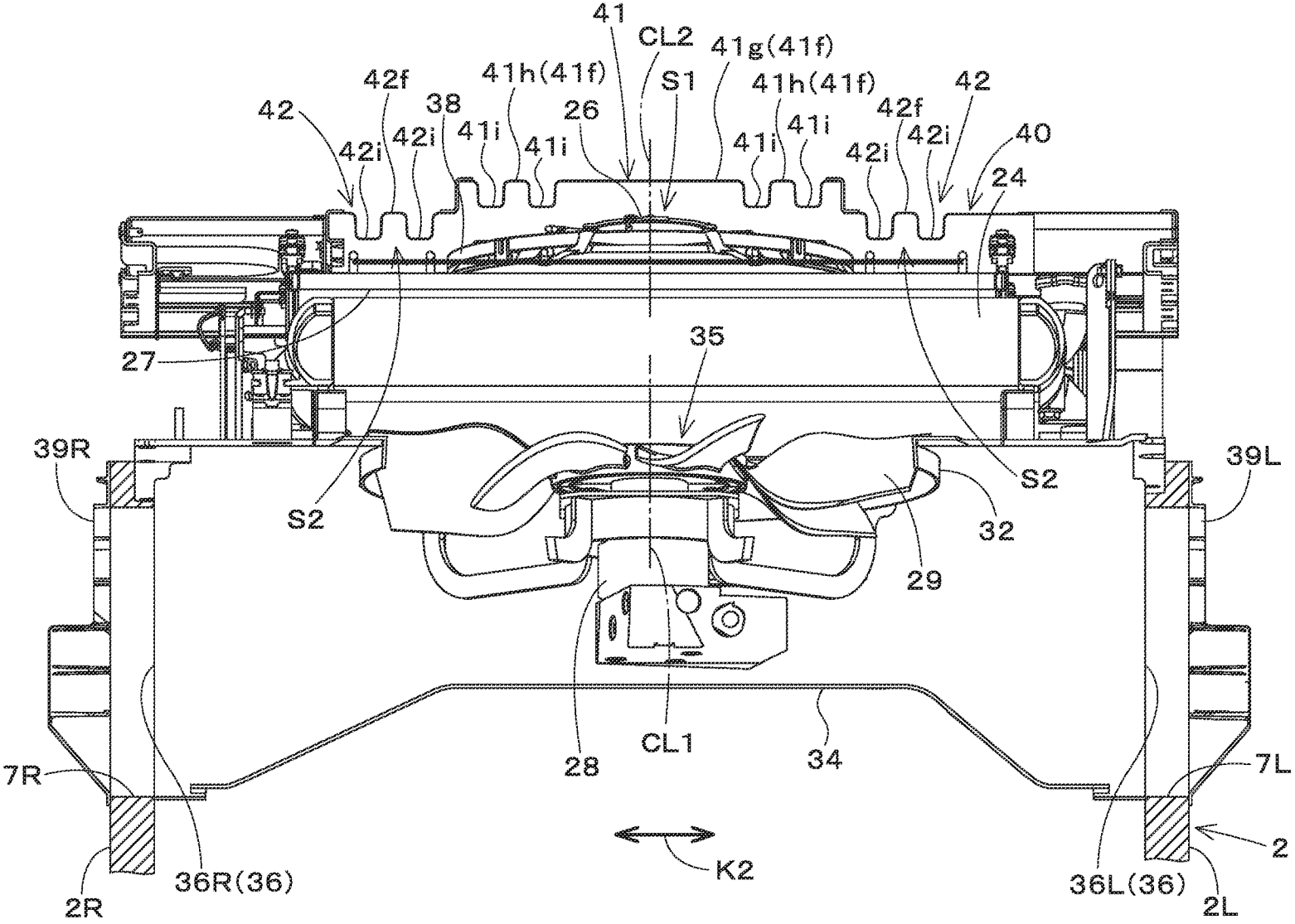

The first blade 29 rotates about the first output shaft 28*a* with the rotation of the first output shaft 28*a*. A rotary center axis of the first output shaft 28*a* (hereinafter referred to as "the first rotation shaft center axis CL1") is inclined upwardly rearward. In this manner, a rotational plane generated by the rotation of the first blade 29 is inclined rearwardly downward, so that the rotational plane is substantially parallel to one directional side surface of the radiator 24. As shown in FIGS. 1 and 2, a first shroud 32 is arranged around the first blade 29. The first shroud 31 is formed in a cylindrical shape and extends along the periphery of the first blade 29.

Figure 3A:
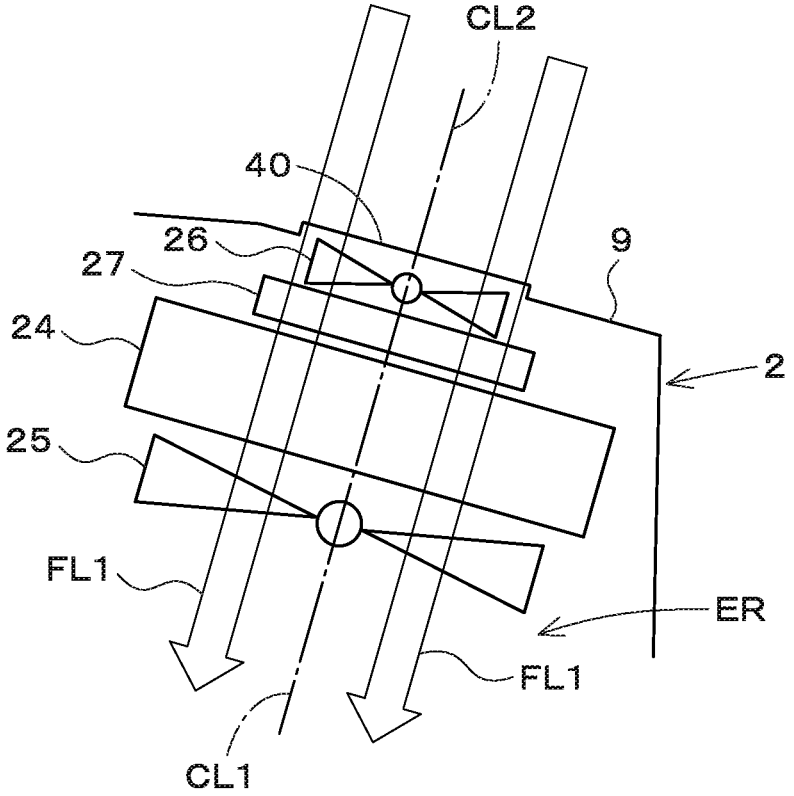
FIG. 3A is a view explaining an airflow generated when the first fan rotates in the first direction.
Figure 3B:
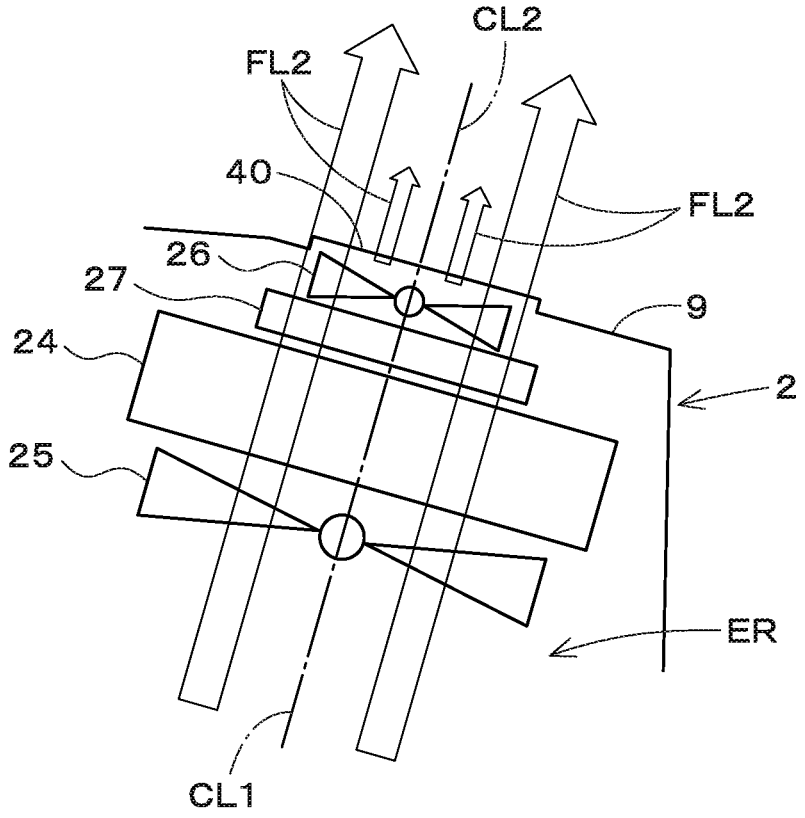
FIG. 3B is a view explaining an airflow generated when the first fan rotates in the second direction.

The first fan 25 is rotatable in first and second directions opposite to each other. The rotational direction of the first fan 25 means the rotational direction of the first blade 29 around the first output shaft 28*a*. As shown in FIG. 3A, when the first fan 25 rotates in the first direction, the first fan 25 generates an airflow (hereinafter referred to as "the first airflow FL1") that brings the outside air into the machine body 2. As shown in FIG. 3B, when the first fan 25 rotates in the second direction, the first fan 25 generates an airflow (hereinafter referred to as "the second airflow FL2") that discharges the air inside the machine body 2 to the outside of the machine body 2. That is, the rotation in the first direction generates the first airflow FL1, and the rotation in the second direction generates the second airflow FL2. The generation of the first airflow FL1 allows the outside air (that is, the air outside the machine body 2) to be introduced into the engine room ER. The generation of the second airflow FL2 causes the air inside the engine room ER to be discharged to the outside of the machine body 2.

The air capacity of the first fan 25 rotated in the first direction is larger than the air capacity of the first fan 25 rotated in the second direction. This difference in air capacity can be achieved, for example, by making the shapes of the blades viewed from the front side (that is, a radiator 24 side) different from the shapes of the blades viewed from the back side (that is, an opposite side to the radiator 24). In addition, it may be achieved by a method of making the rotation speed in the first direction different from the rotation speed in the second direction.

As shown in FIGS. 1 and 2, a second fan 26 is arranged on the other directional surface side (that is, an upper surface side) of the radiator 24. In the present embodiment, the second fan 26 is an electric fan configured to be driven by electric power. The power to drive the second fan 26 is supplied from a battery or the like mounted on the machine body 2. The second fan 26 is driven by the second motor 30. The second motor 30 is an electric motor configured to be operated by electric power. The output shaft of the second motor 30 (hereinafter referred to as "the second output shaft 30*a*") extends downward (specifically, diagonally forwardly downward). A second blade 31 is attached to a lower portion of the second output shaft 30*a*. That is, in the second fan 26, the second blade 31 is arranged on the lower side, and the second motor 30 for rotating the second blade 31 is arranged on the upper side.

The second blade 31 rotates around the second output shaft 30*a* with the rotation of the second output shaft 30*a*. The rotary center axis of the second output shaft 30*a* (hereinafter referred to as the "second rotation shaft center axis CL2") is inclined upwardly rearward. In this manner, a rotational plane generated by the rotation of the second blade 31 is inclined rearwardly downward, so that the rotational plane is substantially parallel to one directional side surface of the radiator 24.

Figure 4:
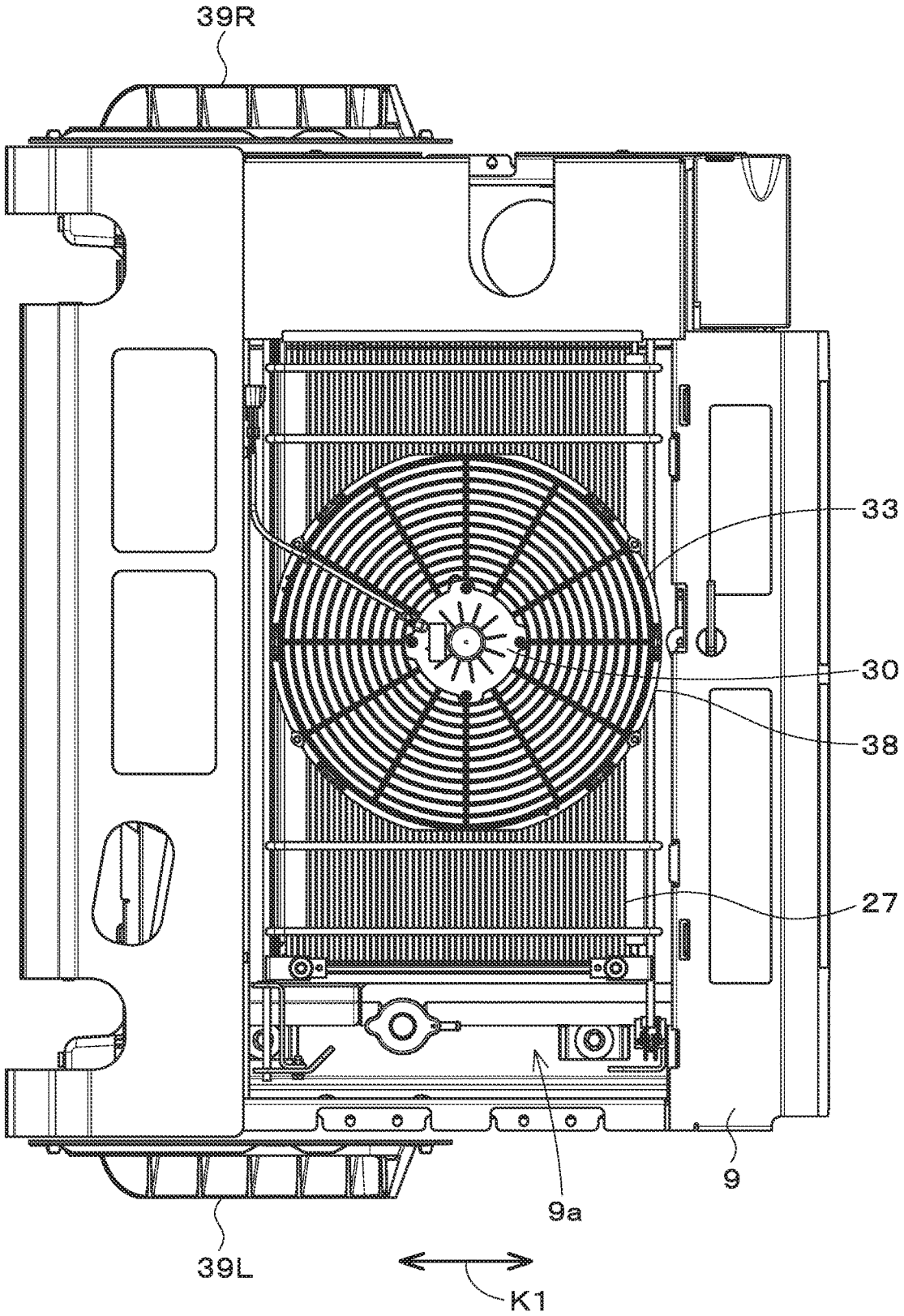
FIG. 4 is a plan view showing a state where the fan cover is removed from a hood.

As shown in FIGS. 1 and 2, a second shroud 38 is arranged around the second blade 31. The second shroud 38 is formed in a cylindrical shape and extends along the periphery of the second blade 31. As shown in FIGS. 1 and 4, a protective cover 33 is provided at an upper portion of the second shroud 38. The protective cover 33 has a grid shape and covers the upper surface of the second blade 31. The second motor 30 is attached to the center of the protective cover 33. The second motor 30 protrudes upward from the protective cover 33.

As shown in FIG. 3, the first rotation shaft center axis CL1 of the first output shaft 28*a* and the second rotation shaft center CL2 of the second output shaft 30*a* may be coaxial to each other. However, in this embodiment as shown in FIG. 1, the first rotation shaft center CL1 and the second rotation shaft center CL2 are offset in the fore-and-aft direction. Specifically, in the embodiment shown in FIG. 1, the first rotation shaft center CL1 is disposed forward from the second rotation shaft center CL2. However, even when arranged in this manner, it is preferable to match the first rotation shaft center CL1 with the second rotation shaft center CL2 in the machine-width direction K2, as shown in FIG. 2.

As shown in FIG. 3, the rotational plane generated by the rotation of the first blade 29 of the first fan 25 and the rotational plane generated by the rotation of the second blade 31 of the second fan 26 are parallel to each other. A diameter of the second fan 26 (that is, a diameter of the second blade 31) is smaller than a diameter of the first fan 25 (that is, a diameter of the first blade 29).

The second fan 26 rotates in the above-described second direction. That is, the second fan 26 rotates in the direction to generate the second airflow FL2 (that is, the airflow for discharging the air inside the machine body 2 to the outside of the machine body 2). The rotational direction of the second fan 26 means the rotational direction the second blade 31 around the second output shaft 30*a*. In the present embodiment, the second fan 26 is configured to rotate only in the second direction. In other words, the second fan 26 is capable of generating the second airflow FL2, but incapable of generating the first airflow FL1.

However, the second fan 26 needs to be rotatable in at least the second direction. Therefore, the second fan 26 may be rotatable in the first and second directions. In this case, the second fan 26 is configured to have a air capacity when rotating in the second direction which is larger than that when rotating in the first direction.

As shown in FIGS. 1, 2, and 3, a condenser 27 is disposed above the radiator 24. The condenser 27 is disposed between the radiator 24 and the second fan 26. Specifically, the condenser 27 is disposed above the radiator 24 and below the second fan 26. The condenser 27 condenses refrigerant of the air conditioner configured to supply temperature-controlled air to the inside of the cabin 3 mounted on the machine body 2.

As shown in FIGS. 1 and 2, the first fan 25 is arranged inside the duct 34. The radiator 24, the condenser 27, and the second fan 26 are arranged above the duct 34. The engine 22 is arranged below the duct 34. The duct 34 defines an air flow passage and has an upper opening 35 and at least one side opening 36. The upper opening 35 faces one directional surface side (that is, the lower surface side) of the radiator 24. A first shroud 32 surrounding the first blade 29 is fitted in the upper opening 35. The at least one side opening 36 includes a left side opening 36L and a right side opening 36R. The left side opening 36L is joined to a left opening 7L formed in a left side wall 2L of the machine body 2. The right side opening 36R is joined to a right opening 7R formed in a right side wall 2R of the machine body 2. A grid plate 39L is provided to cover the left opening 7L. The right opening 7R is provided to cover a grid plate 39R.

When the first airflow FL1 is generated by the first fan 25 rotating in the first direction, the outside air is taken into the inside of the machine body 2 through a ventilation hole 40*a* (see FIG. 6) provided in a later-discussed fan cover 40, passes through the condenser 27 and the radiator 24, and then enters the duct 34 from the upper opening 35 and is discharged from the side openings 36 to the outside of the machine body 2. Therefore, the condenser 27 and the radiator 24 are cooled by the outside air. The engine room ER is provided with a front opening 37 (see FIG. 1) formed above the duct 34 and in front of the radiator 24, and the air warmed in the engine room ER is introduced into the duct 34 through the front opening 37, and is discharged from the side openings 36 to the outside of the machine body 2. In this manner, the temperature in the engine room ER is lowered.

Figure 5:
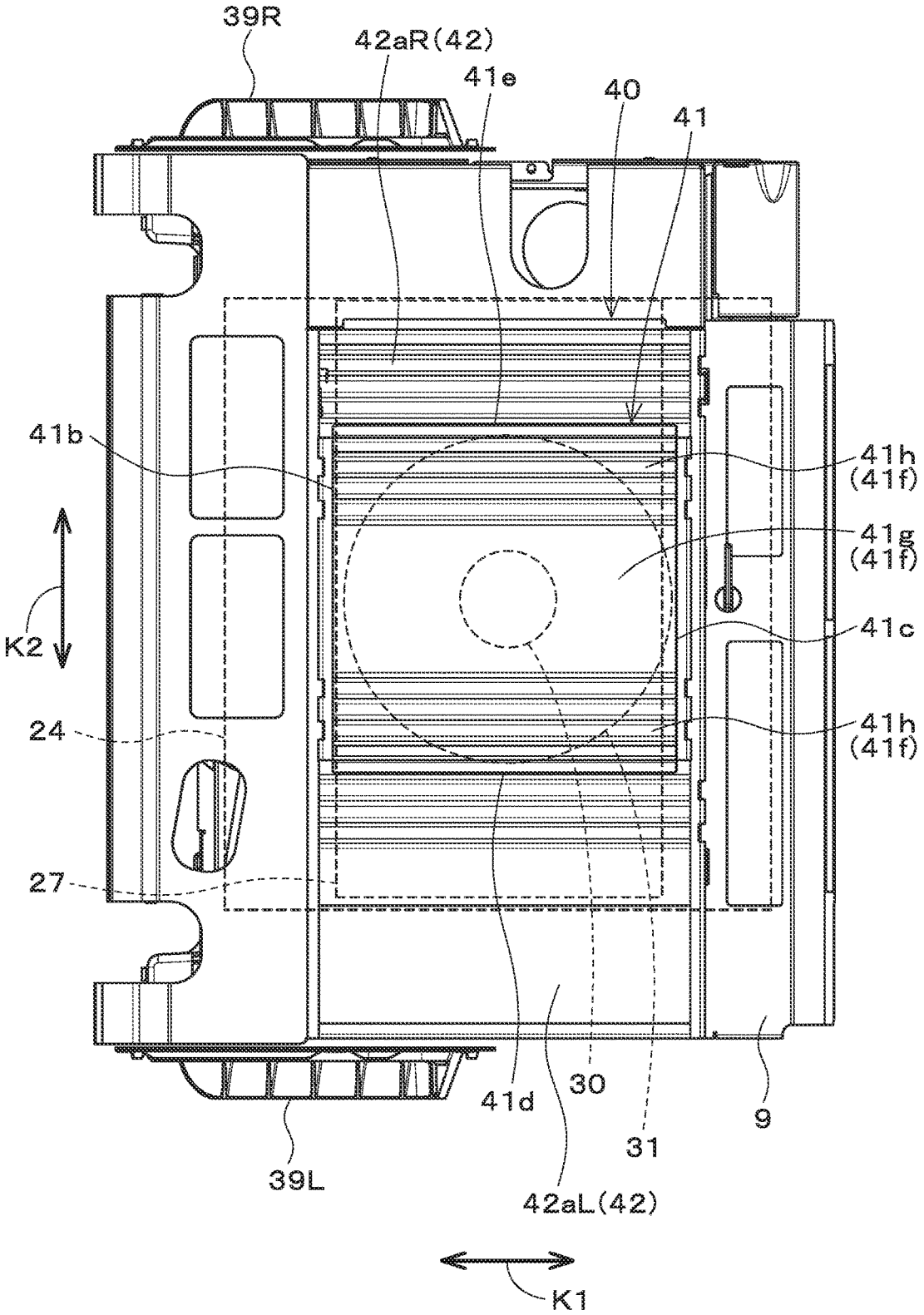
FIG. 5 is a plan view showing a state where the fan cover is attached to the hood.

As shown in FIGS. 1, 2, and 5, the fan cover 40 is provided above the second fan 26 to cover the upper side of the second fan 26 (opposite to the condenser 27). The fan cover 40 is attached to the hood 9 provided at an upper rear portion of the machine body 2. The fan cover 40 is attached to cover a ventilation opening 9*a* (see FIGS. 1 and 4) formed in the hood 9.

As shown in FIG. 1, the fan cover 40 protrudes upward from the upper surface of the hood 9. The upper surface of the fan cover 40 is inclined downwardly rearward. As shown in FIG. 5, in plan view, the fan cover 40 covers the entire second fan 26 and the substantially entire condenser 27. Thus, by removing the fan cover 40, the second fan 26 and the condenser 27 can be accessed from above for maintenance and the like.

Figure 6:
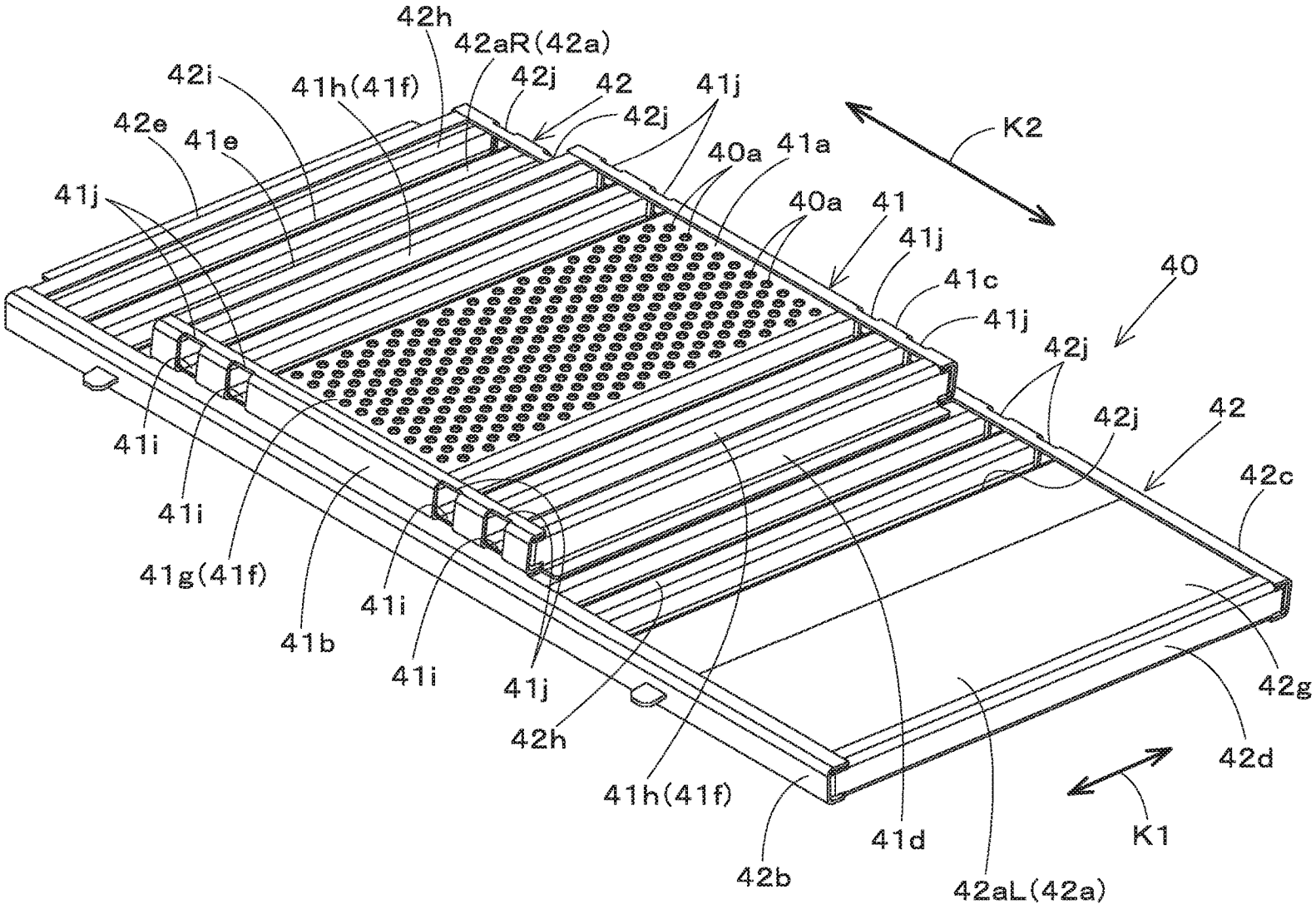
FIG. 6 is a perspective view of the fan cover seen from the upper left front.

As shown in FIG. 6, the fan cover 40 has ventilation holes 40*a* allowing an air flow therethrough. The ventilation holes 40*a* are joined to the ventilation opening 9*a* formed in the hood 9. In the present embodiment, the fan cover 40 is formed of perforated metal, and perforations in the perforated metal serve as the ventilation holes 40*a*. In FIG. 6, the fan cover 40 is illustrated as being formed in only a portion of the upper surface thereof with ventilation holes 40*a*, but it is preferable that the ventilation holes 40*a* are provided in the entire upper surface of the fan cover 40. In the drawings other than FIG. 6, the ventilation holes 40*a* are not shown.

Figure 7:
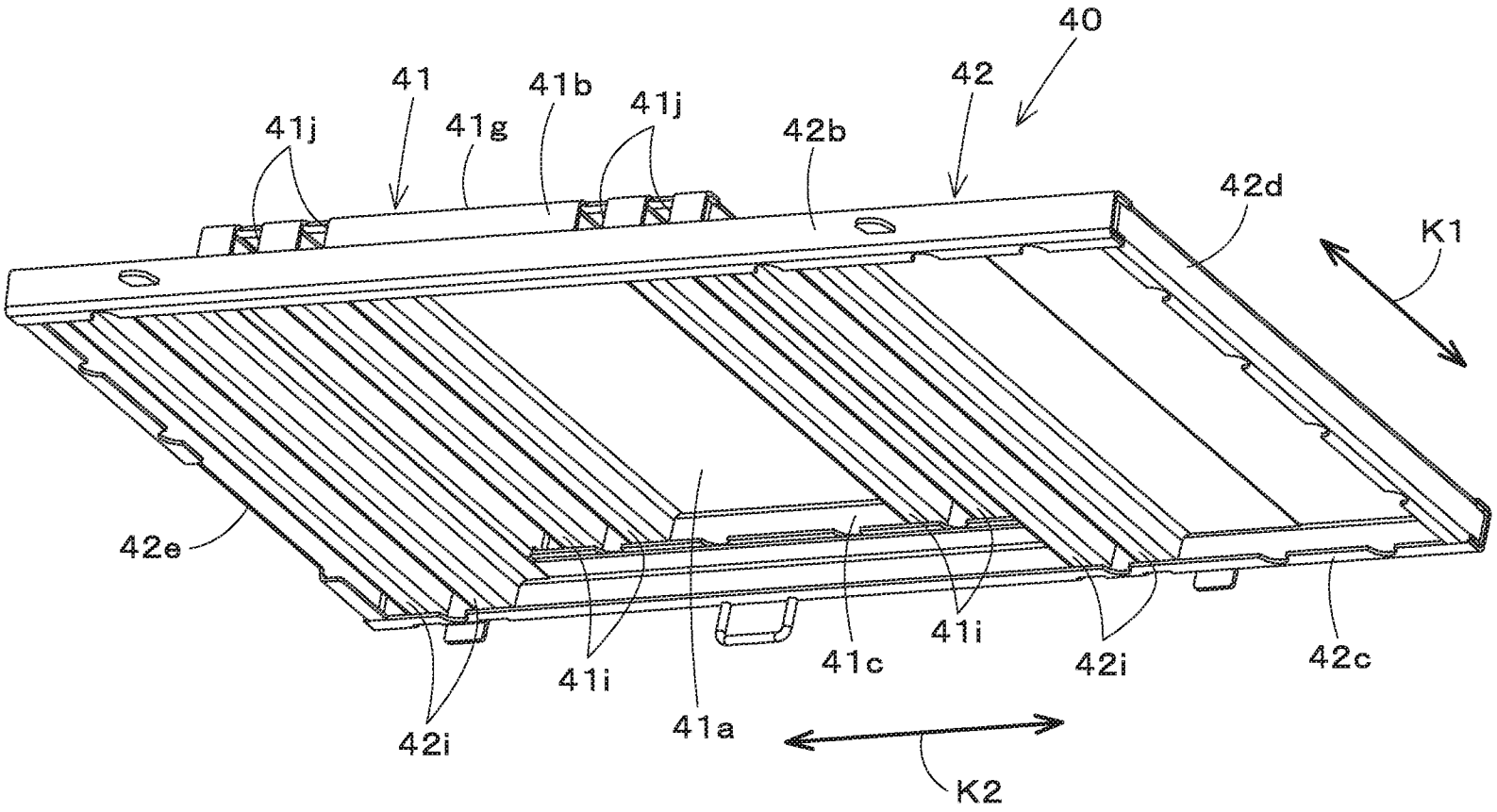
FIG. 7 is a perspective view of the fan cover seen from the lower left front.

As shown in FIGS. 5, 6, and 7, the fan cover 40 has a first portion 41 and second portions 42. The fan cover 40 has an outline formed in a convex shape when viewed from the front, with the first portion 41 defining an upper portion of the convex shape and the second portion 42 defining a lower portion of the convex shape. In other words, the first portion 41 is formed at a position higher than the second portion 42. The first portion 41 is disposed in the vicinity of the center of the fan cover 40 in the machine-width direction K2. The second portion 42 includes left and right portions disposed on left and right sides of the first portion 41 in the machine-width direction K2. The first portion 41 and the second portion 42 may be formed integrally in an inseparable state, or the first portion 41 may be detachable from the second portions 42.

The first portion 41 includes a first upper plate 41*a*, a first front plate 41*b*, a first rear plate 41*c*, a first left plate 41*d*, and a first right plate 41*e*. The first upper plate 41*a* is rectangular in plan view. The first front plate 41*b* extends in the machine-width direction K2 along a front edge of the first top plate 41*a*. The first rear plate 41*c* extends in the machine-width direction K2 along a rear edge of the first upper plate 41*a*. The first left plate 41*d* extends in the fore-and-aft direction K1 along a left edge of the first upper plate 41*a*. The first right plate 41*e* extends in the fore-and-aft direction K1 along a right edge of the first upper plate 41*a*. The first front plate 41*b*, the first rear plate 41*c*, the first left plate 41*d*, and the first right plate 41*e* have their upper edges arranged along an upper surface of the first upper plate 41*a* and their lower edges positioned below the first upper plate 41*a*.

A first upper surface 41*f*, which is an upper surface of the first upper plate 41*a*, includes a first flat surface 41*g* and first uneven surfaces 41*h*. The first flat surface 41*g* having a predetermined width is formed at the center of the first upper surface 41*f* in the machine-width direction K2. The first uneven surfaces 41*h* are formed on the left and right sides of the first flat surface 41*g*, respectively. The first uneven surface 41*h* has first concave portions 41*i* concaved downward. The first concave portions 41*i* define grooves extending in the fore-and-aft direction K1. The first front plate 41*b* and the first rear plate 41*c* have first openings 41*j* at positions corresponding to the first concave portions 41*i*. In this manner, rainwater and dusts accumulated in the first concave portions 41*i* can be discharged through the first opening 41*j*.

As shown in FIG. 5, in plan view, the first upper surface 41*f* covers the entire second fan 26 (including the second motor 30 and the second blade 31). In addition, the first flat surface 41*g* is disposed to overlap the second motor 30 of the second fan 26 in plan view. In other words, the first upper surface 41*f* is arranged to entirely cover the second fan 26 from above, and the first flat surface 41*g* is arranged to cover the second motor 30 from above.

The second portion 42 includes second upper plates 42*a*, a second front plate 42*b*, a second rear plate 42*c*, a second left plate 42*d*, and a second right plate 42*e*. The second upper plates 42*a* are disposed lower than the first upper plate 41*a*. The second upper plates 42*a* include a second upper plate 42*a*L extended leftward from the first upper plate 41*a* and a second upper plate 42*a*R extended rightward from the first upper plate 41*a* in the machine-width direction K2. That is, the second upper plate 42*a*L and the second upper plate 42*a*R are spaced from each other in the machine-width direction K2. Each of the second upper plate 42*a*L and the second upper plate 42*a*R is rectangular in plan view.

The second front plate 42*b* extends in the machine-width direction K2 so as to connect a front edge of the second upper plate 42*a*L and a front edge of the second upper plate 42*a*R to each other. The second rear plate 42*c* extends in the machine-width direction K2 so as to connect a rear edge of the second upper plate 42*a*L and a rear edge of the second upper plate 42*a*R to each other. The second left plate 42*d* extends in the fore-and-aft direction K1 along a left edge of the second upper plate 42*a*. The second right plate 42*e* extends in the fore-and-aft direction K1 along a right edge of the second upper plate 42*a*. The second front plate 42*b*, the second rear plate 42*c*, the second left plate 42*d*, and the second left plate 42*d* include respective upper edges extended along an upper surface of the second upper plate 42*a* and include respective lower edges disposed below the second upper plates 42*a*.

A second upper surface 42*f*, which is an upper surface of the second upper plate 42*a*, includes a second flat surface 42*g* and second uneven surfaces 42*h*. The second flat surface 42*g* having a predetermined width is formed as a left portion of the second upper surface 42*f* of the second upper plate 42*a*L. The second uneven surfaces 42*h* are formed as a right portion of the second upper surface 42*f* of the second upper plate 42*a*L and as the entire second upper surface 42*f* of the second upper plate 42*a*R. Each of the second uneven surfaces 42*h* includes second concave portions 42*i* concaved downward. The second concave portions 42*i* define grooves extending in the fore-and-aft direction K1. The second rear plate 42*c* has second openings 42*j* at positions corresponding to the respective second concave portions 42*i*. In this manner, rainwater and dusts accumulated in the second concave portions 42*i* can be discharged from the second openings 42*j*.

Since the fan cover 40 has the first concave portions 41*i* and the second concave portions 42*i*, the surface area of the fan cover 40 is increased so as to improve the heat radiation efficiency. Therefore, the heat in the engine room ER can be efficiently released to the outside. In addition, the strength of the fan cover 40 can be enhanced by the first concave portions 41*i* and the second concave portions 42*i* provided in the fan cover 40. Accordingly, even when an external force is applied to the fan cover 40, the fan cover 40 is suppressed from being deformed. Moreover, when dusts accumulate on the upper surface of the fan cover 40, the dusts tend to accumulate in the lowered first and second concave portions 41*i* and 42*i*, so that the dusts hardly accumulate in higher portions other than the first and second portions 41*i* and 42*i*. Accordingly, the accumulation of dusts over the entire upper surface of the fan cover 40 is suppressed.

As shown in FIG. 2, in the fan cover 40, the first space S1 formed below the first upper surface 41*f* of the first portion 41 expands upward compared to the second space S2 formed below the second upper surface 42*f* of the second portion 42. Accordingly, below the fan cover 40, the first space S1 serves as a sufficiently wide space that can incorporate the second fan 26. In other words, the second fan 26 can be arranged in the wide first space S1 formed below the first upper surface 41*f*.

While the first upper surface 41*f* including the first flat surface 41*g* and the first uneven surfaces 41*h* is disposed above the second fan 26, the first flat surface 41*g* including no concave such as the first concave portions 41*i* is disposed above the second motor 30, thereby being prevented from interfering with the second motor 30.

If the first upper surface 41*f* included only the first uneven surface 41*h* without the first flat surface 41*g*, the first concave portions 41*i* would be disposed above the second motor 30. In this case, in order to prevent interference between the second motor 30 and the first concave portions 41*i*, the first upper surface 41*f* needs to be raised by the depths (that is, heights) of the first concave portions 41*i*; however, if the first upper surface 41*f* were raised, the first upper surface 41*f* would hinder the rearward view of an operator sitting on the driver seat 8 in the cabin 3, thereby causing inconvenience. Therefore, in the present embodiment, the first upper surface 41*f* has the first flat surface 41*g* such as to eliminate interference between the second motor 30 and the first concave portions 41*i*. Accordingly, there is no need to raise the first upper surface 41*f* by the depths of the first concave portions 41*i*, and the height of the first upper surface 41*f* can be lowered. As the result, the above-mentioned inconvenience of deteriorating the rearward view of the operator does not occur.

Figure 8:
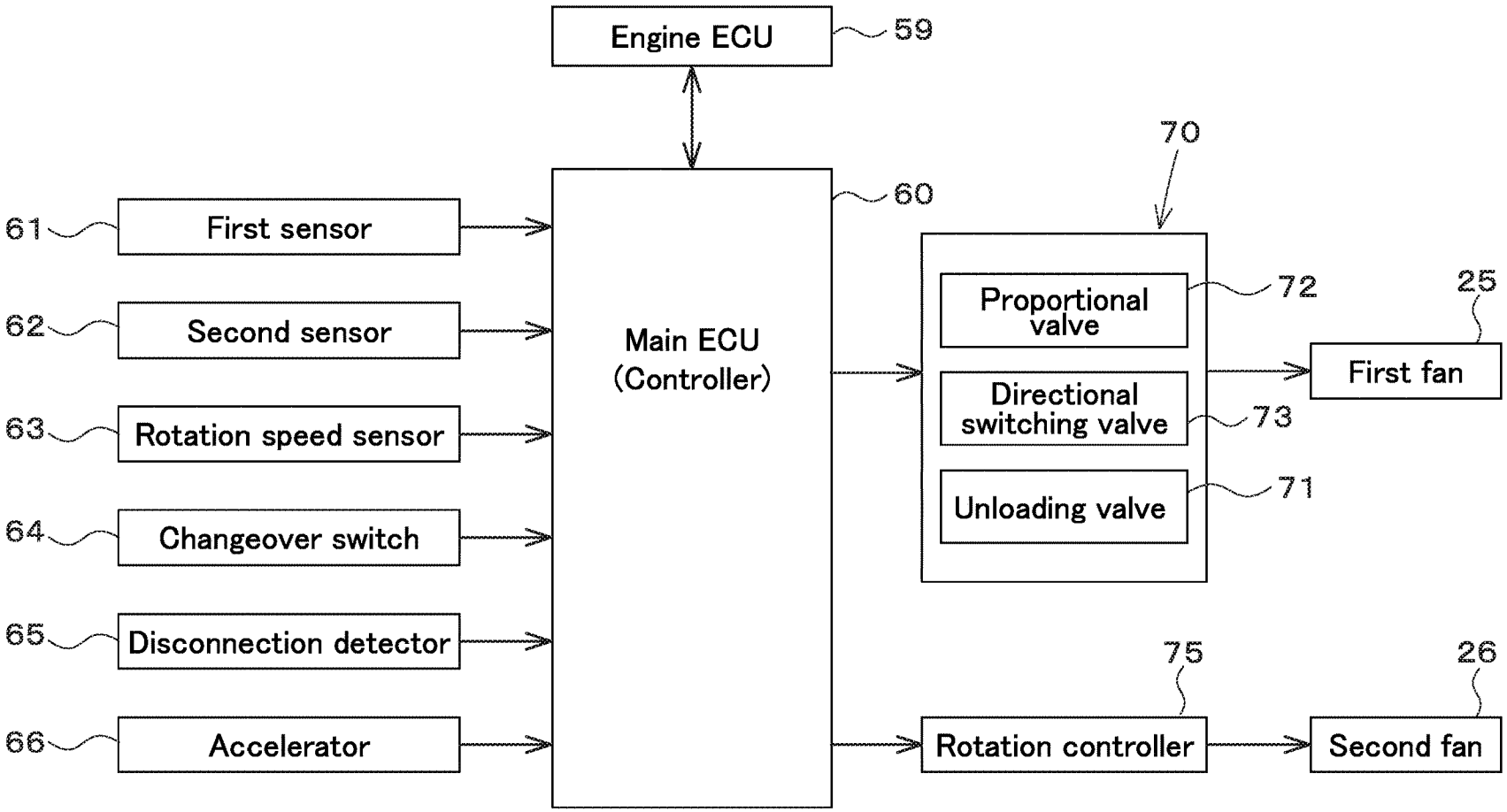
FIG. 8 is a block diagram showing a configuration of a control system of a working machine.

As shown in FIG. 8, the working machine 1 is provided with a controller 60. The controller 60 is configured or programmed to perform various controls relating to the working machine 1, includes a semiconductor such as a CPU and a MPU, an electric or electronic circuit, or the like, and includes a storage storing various control programs. The controller 60 includes a main electronic control unit (hereinafter referred to as the "main ECU") that performs controls relating to traveling and controls relating to work. In addition, an electronic control unit for the engine (referred to as an engine ECU) 59 is electrically connected to the controller 60 via a Controller Area Network (referred to as the CAN).

The controller 60 is configured or programmed to receive signals (that is, detection signals and the like) from a first sensor 61, a second sensor 62, a rotation speed sensor 63, a changeover switch 64, a disconnection detector 65, and an accelerator 66. In addition, the controller 60 is configured or programmed to transmit control signals to the first fan 25 and the second fan 26.

The first sensor 61 is an operation fluid temperature sensor configured to detect a temperature of the operation fluid for operating the working device 4. The second sensor 62 is a coolant temperature sensor configured to detect a temperature of the coolant for cooling the engine 22. The first sensor 61 and the second sensor 62 include respective fault detectors that detect faults in the respective sensors. Each of the fault detectors, when detecting a fault of the corresponding first or second sensor 61 or 62, transmits a detection signal to the controller 60.

The rotation speed sensor 63 is a sensor configured to detect a rotation speed (specifically, an actual rotation speed) of the engine 22. The rotation speed (the actual rotation speed) of the engine 22 detected by the rotation speed sensor 63 is input (or transmitted) to the controller 60.

The changeover switch 64 is a switch shiftable between an ON-state to permit rotation of the first fan 25 in the second direction and an OFF-state to forbid the rotation. A switching signal (that is, ON-signal or OFF-signal) of the changeover switch 64 is input (that is, transmitted) to the controller 60. The changeover switch 64 is manually operable to be switched between the ON-state and the OFF-state, and when it is switched ON, the rotational direction of the first fan 25 is switched from the first direction to the second direction, and when it is switched OFF, the rotational direction of the first fan 25 returns to the first direction. The controller 60, when receiving the signal from the changeover switch 64, performs the switching of rotational direction by switching a later-discussed directional switching valve 73.

The disconnection detector 65 detects disconnection of harnesses that transmit the control signals for controlling driving of the first fan 25 and the second fan 26. When the disconnection detector 65 detects disconnection of the harness, a detection signal is input (or transmitted) to the controller 60.

The accelerator 66 is provided in the vicinity of the driver seat 8. The accelerator 66 is a setting member for setting a rotation speed of the engine 22 (that is, an instructed rotation speed). The accelerator 66 is, for example, an acceleration lever, an accelerator pedal, a acceleration volume, an acceleration slider, or the like. The instructed rotation speed (referred to as a target speed) of the engine 22 set by the accelerator 66 is input (or transmitted) to the controller 60.

The first fan 25 is fluidly connected to a control valve 70 for controlling rotation of the first fan 25. The control valve 70 is controlled by a control signal from the controller 60. The control valve 70 is fluidly connected via a hydraulic circuit to the first motor 28 for driving the first fan 25, and controls a flow of the operation fluid supplied to the first motor 28. In the present embodiment, as shown in FIG. 8, the control valve 70 includes an unloading valve 71, a proportional valve 72, and the directional switching valve 73. However, the control valve 70 need not include the unloading valve 71. The control valve 70 includes a second fault detector for detecting fault of the control valve 70.

The unloading valve 71 is a valve for rotating or stopping the first fan 25. When the unloading valve 71 is closed, operation fluid is supplied to the first motor 28 for driving the first fan 25. When the unloading valve 71 is opened, the supply of operation fluid to the first motor 28 is stopped. Accordingly, the first fan 25 rotates when the unloading valve 71 is closed, and the first fan 25 stops when the unloading valve 71 is opened.

The proportional valve 72 is a relief valve for changing (that is, increasing or decreasing) a rotation speed of the first fan 25 when the unloading valve 71 is closed. The proportional valve 72 changes an opening degree corresponding to a supplied current value, and the amount of operation fluid supplied to the first motor 28 increases or decreases according to variation of the opening degree, thereby increasing or decreasing a rotation speed of the first fan 25. Specifically, as the current value increases, the opening degree increases, the amount of operation fluid supplied to the first motor 28 decreases, and the rotation speed of the first fan 25 decreases. As the current value decreases, the opening degree decreases, the amount of operation fluid supplied to the first motor 28 increases, and the rotation speed of the first fan 25 increases. When the proportional valve 72 is fully open, the rotation speed of the first fan 25 becomes the minimum speed. When the proportional valve 72 is fully closed, the rotation speed of the first fan 25 becomes the maximum speed.

The directional switching valve 73 is a bidirectional switching valve and configured to switch a flow direction of the operation fluid supplied to the first motor 28 between one and the other opposite directions. When the operation fluid flows in one direction, the first motor 28 rotates in one direction, and the first fan 25 rotates in the first direction. When the operation fluid flows in the other direction, the first motor 28 rotates in the other direction, and the first fan 25 rotates in the second direction.

As shown in FIG. 8, the second fan 26 has a rotation controller 75 configured or programmed to control a rotation of the second fan 26. The rotation controller 75 includes an electric circuit including an inverter and the like. The rotation controller 75 controls a timing of driving or stopping the second fan 26 by receiving a control signal from the controller 60. The controller 60 controls the driving of the first fan 25 and the second fan 26.

Figure 9:
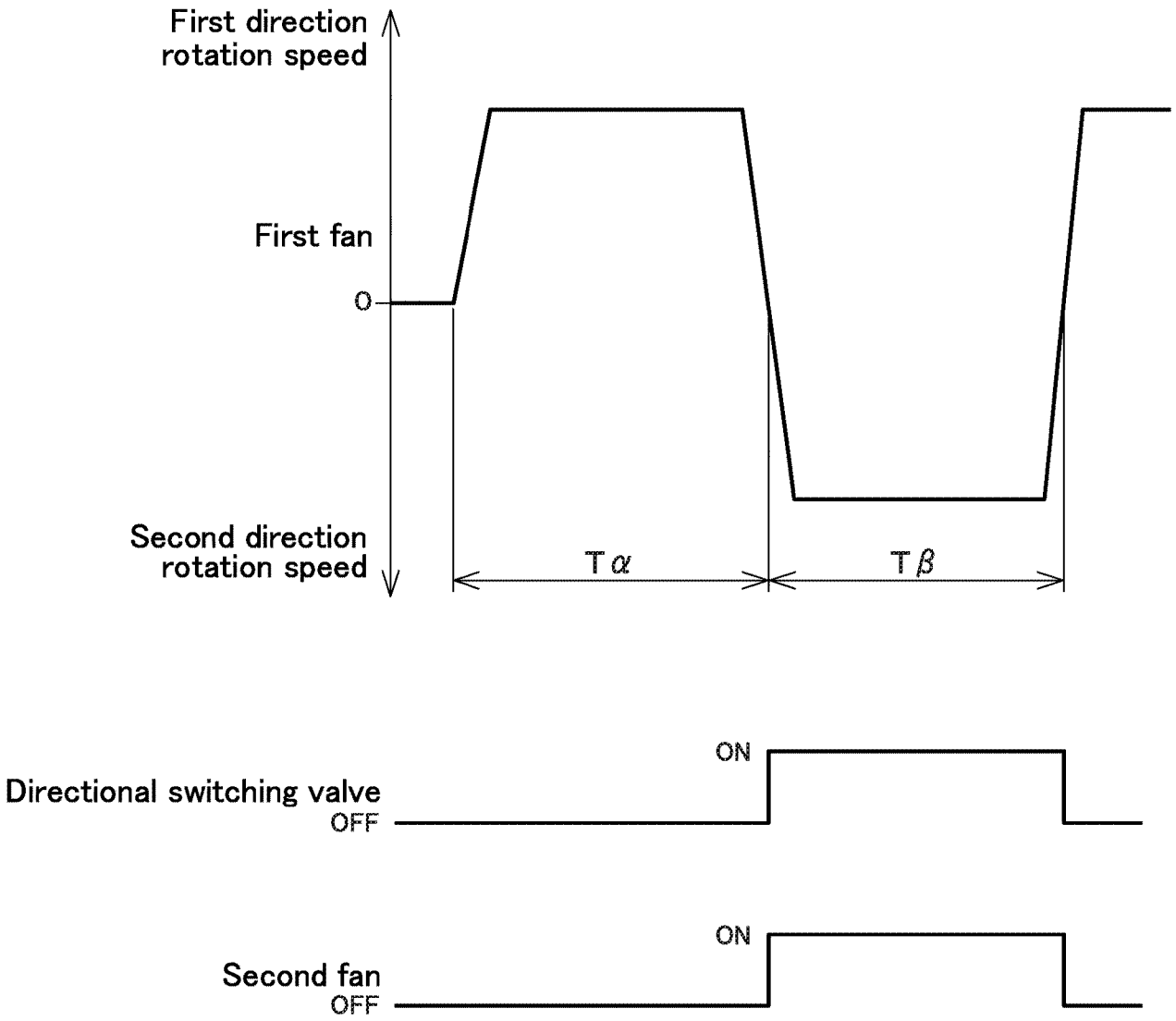
FIG. 9 is a view showing an example of an action pattern of the first fan, the second fan, and a directional switching valve.

FIG. 9 illustrates an example of action patterns of the first fan 25, the second fan 26, and the directional switching valve 73 controlled by the controller 60, and the horizontal axis represents an axis of time.

As shown in FIG. 9, the controller 60 stops the second fan 26 while the first fan 25 rotates in the first direction (that is, in a period Ta) and drives the second fan 26 while the first fan 25 is rotating in the second direction (that is, in a period Tβ). The second fan 26 is driven to rotate in the second direction.

The rotational direction of the first fan 25 is changed by switching of the directional switching valve 73 by the controller 60. The controller 60 controls the rotation controller 75 for controlling driving and stopping of the second fan 26.

When the drive of the second fan 26 is stopped, the rotation of the second motor for driving the second fan 26 is stopped. At this time, the blades of the second fan 26 may be completely stationary, or they may rotate following the rotation of the first fan 25 in the same rotational direction as the first fan 25 by the airflow generated by the first fan 25 rotating in the first direction.

As shown in FIG. 9, while the first fan 25 is rotating in the first direction (that is, for the period Ta), the first airflow FL1 that introduces the outside air into the inside of the machine body 2 is generated to cool the radiator 24 and the condenser 27. While the first fan 25 is rotating in the second direction (that is, for the period Tβ), the second air flow FL2 is generated to discharge the air inside the machine body 2 to the outside of the machine body 2. The second airflow FL2 can blow away dusts adhering to the radiator 24 and dusts deposited on the hood 9.

However, the first fan 25 alone rotating in the second direction may not provide sufficient airflow for blowing away the dusts. Especially, ducts existing at a position corresponding to the central portion of the first fan 25 may be insufficiently blown away because the air capacity of the central portion of the first fan 25 and its vicinity (that is, a portion close to the rotation shaft) is smaller than the air capacity of the peripheral portion of the first fan 25 (that is, a portion separating away from the rotation shaft).

For this reason, the controller 60 drives the second fan 26 to rotate in the second direction while the first fan 25 is rotating in the second direction (that is, for the period Tβ), as shown in FIG. 9. In this manner, the second fan 26 also generates the second airflow FL2 that discharges the air inside the machine body 2 to the outside of the machine body 2. The air capacity generated by the rotation of the second fan 26 can compensate for the insufficient air capacity generated by the rotation of the first fan 25 alone. That is, the rotation of the second fan 26 increases the air capacity of the second air flow FL2 for discharging the air inside the machine body 2 to the outside of the machine body 2. Accordingly, dusts that cannot be blown away by the rotation of the first fan 25 alone can be blown away.

In addition, when the center axis of the rotation shaft of the first fan 25 and the center axis of the rotation shaft of the second fan 26 are arranged coaxially to each other, and the second fan 26 is diametrically smaller than the first fan 25, the outer peripheral portion of the second fan 26 and its vicinity is positioned to correspond to the vicinity of the central portion of the first fan 25. Accordingly, the larger air capacity portion of the second fan 26 (that is, the outer peripheral portion of the second fan 26 and its vicinity) is disposed in correspondence to the less air capacity portion of the first fan 25 (that is, the central portion of the first fan 25 and its vicinity). Therefore, the dusts that cannot be blown away by the rotation of the first fan 25 alone can be blown away more reliably.

As described above, the air capacity of the first fan 25 when rotated in the first direction is larger than the air capacity thereof when rotated in the second direction. In this manner, when the first fan 25 is rotated in the first direction, the air capacity of the first fan 25 alone can provide sufficient cooling effect. On the other hand, when the first fan 25 is rotated in the second direction, the second fan 26 also rotates in the second direction, so that their air capacity for blowing away dusts is not insufficient. That is, both the cooling effect of the radiator 24 and the like and the effect of blowing away the dust can be surely obtained.

Figure 10:
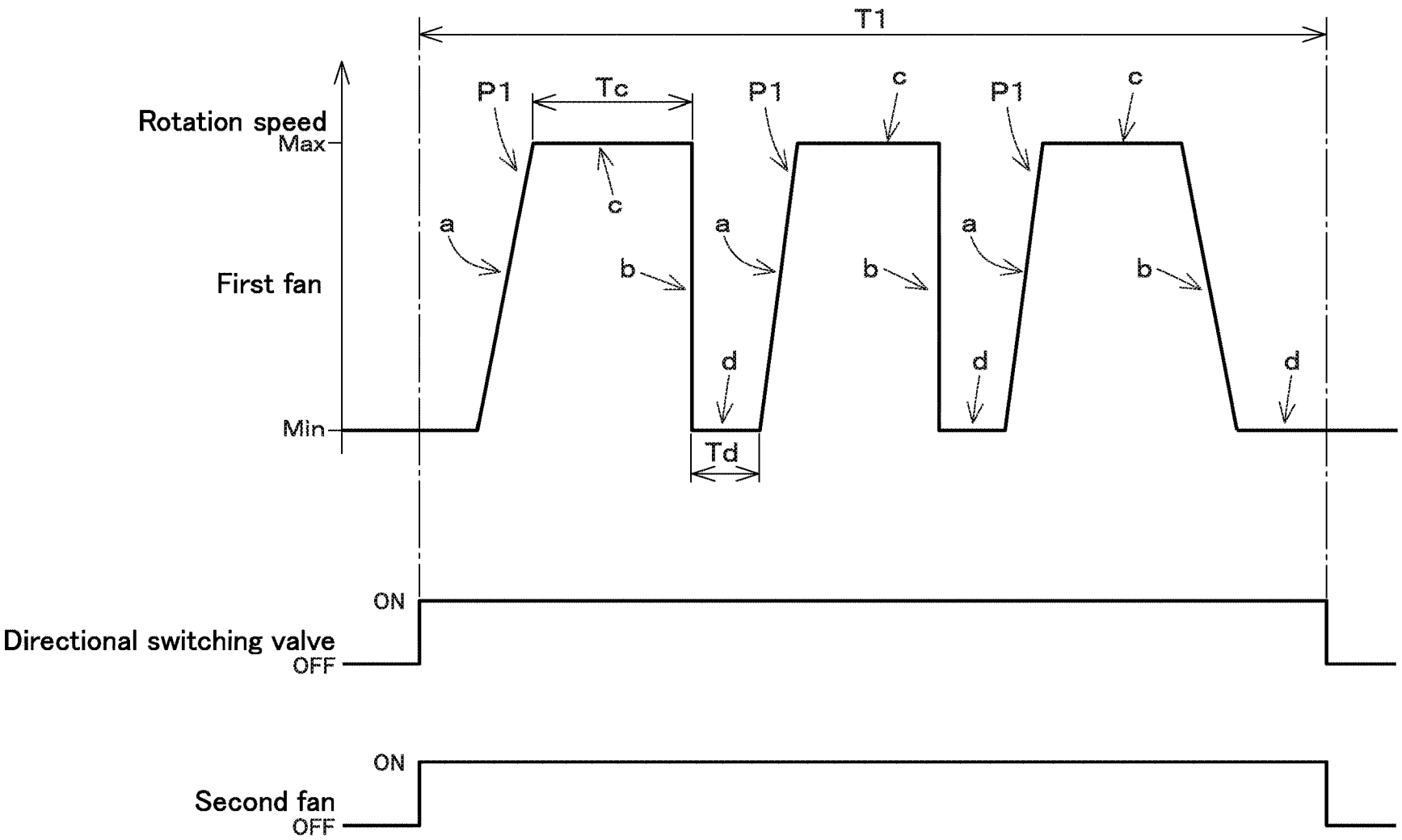
FIG. 10 is a view showing another example of the action pattern of the first fan, the second fan, and the directional switching valve.

FIG. 10 illustrates another example of an action pattern of the first fan 25, the second fan 26, and the directional switching valve 73 controlled by the controller 60, and the horizontal axis represents an axis of time.

First, an operation control of the first fan 25 by the controller 60 will be described.

As shown in FIG. 10, the controller 60 drives the first fan 25 to repeat a process of actions P1, which includes a speed-increasing action a to increase a second direction rotation speed and a speed-reducing action b to reduce the second direction rotation speed having been increased by the speed-increasing action a, within the predetermined period T1. The repeating the process of actions P1 within the predetermined period T1 means that the process of actions P1 is performed multiple times within the predetermined period T1. In the example shown in FIG. 10, the process of actions P1 is performed three times within the predetermined period T1, but the number of times of the process of actions P1 may be two, four, or more.

The speed-increasing action a and the speed-reducing action b are performed by increasing or decreasing a current value to be supplied to the proportional valve 72. The speed-increasing action a is performed by decreasing the current value to be supplied to the proportional valve 72 to increase an opening degree of the proportional valve 72. The speed-reducing action b is performed by increasing the current value to be supplied to the proportional valve 72 to decrease the opening degree of the proportional valve 72. That is, the change in the current value supplied to the proportional valve 72 is opposite to the change in the rotation speed of the first fan 25.

When the current value supplied to the proportional valve 72 is at its maximum, the first fan 25 is at its minimum rotation speed. This minimum speed is a low speed close to zero, but may be zero. When the current value supplied to the proportional valve 72 is at its minimum, the first fan 25 is at its maximum rotation speed. In FIG. 10, a part indicated by a sign c is a part where the rotation speed of the first fan 25 is at the maximum. A part indicated by a sign d is a part where the rotation speed of the first fan 25 is the minimum.

As shown in the left part of FIG. 10, the controller 60 performs a first switching action to switch the rotational direction of the first fan 25 from the first direction to the second direction before starting the repetition of the process of actions P1. Specifically, the controller 60 first rotates the first fan 25 in the first direction at the minimum speed. Then, the controller 60 performs the first switching action to switch the rotational direction of the first fan 25 from the first direction to the second direction. The first switching action is performed by switching the directional switching valve 73 from the OFF state to the ON state. The first switching action is performed when the rotation speed of the first fan 25 is the minimum speed.

After the first switching action is performed, that is, after the first fan 25 starts rotating in the second direction at the minimum speed, the first speed-increasing action a of the above process of actions P1 is performed, and the process of actions P1 including the speed-increasing action a is repeated within the predetermined period T1. The first fan 25 continues to rotate in the second direction for a predetermined period of time T1 after its rotational direction is switched from the first direction to the second direction by the first switching action.

As shown in the right part of FIG. 10, the controller 60 performs a second switching action to switch the rotational direction of the first fan 25 from the second direction to the first direction after the repetition of the process of actions P1 is ended. The second switching action is performed by switching the directional switching valve 73 from the ON state to the OFF state. The second switching action is performed when the rotation speed of the first fan 25 is at the minimum speed after the last speed-reducing action b of the above process of actions P1 is performed.

As described above, the first fan 25 can reliably blow away dusts for a long time by repeating the process of actions P1 including the speed-increasing action a and the speed-reducing action b within the predetermined period T1. When the rotation of the first fan 25 in the second direction is continued for a long period of time at a constant high rotation speed, a negative pressure (that is, a suction pressure) may be generated on the hood from which the wind blows out, thereby making it impossible to blow away the dust. However, as described above, by repeatedly increasing or decreasing the rotation speed during the rotation of the first fan 25 in the second direction, the negative pressure (that is, the suction pressure) is prevented from being generated on the hood from which the wind blows out. Accordingly, dusts can be blown away reliably for a long time.

As shown in FIG. 10, the controller 60 increases the rotation speed in the second direction to the maximum speed by performing the speed-increasing action a, and decreases the rotation speed in the second direction to the minimum speed by performing the speed-reducing action b. Due to the repetition of actions, the above-mentioned generation of the negative pressure can be further surely prevented, and due to the air capacity increased by the increase in the rotation speed from the minimum rotation speed to the maximum rotation speed, the dusts can be blown away reliably by the power of the air capacity that increases greatly with the increase in the rotation speed.

In the process of actions P1, the controller 60 controls the drive of the first fan 25, so that a time Tc of rotation at the maximum rotation speed is longer than a time Td of rotation at the minimum rotation speed (Tc>Td). In this manner, it is possible to obtain a longer time in which the air capacity of the second airflow FL2 blowing away the dusts is large, and accordingly the dust can be blown away more reliably.

Alternatively, in the process of actions P1, the controller 60 may control the drive of the first fan 25, so that the time Td of rotation at the minimum rotation speed is longer than the time Tc of rotation at the maximum rotation speed (Td>Tc). In this case, dusts can be effectively blown away by increasing the air capacity of the first fan 25 with increase of the rotation speed of the first fan 25 from the minimum to the maximum.

In the process of actions P1, the controller 60 may control the drive of the first fan 25, so that the time Tc for rotation at the maximum speed becomes the same as the time Td for rotation at the minimum speed (Tc=Td).

Next, control of the action of the second fan 26 by the controller 60 will be described.

As shown in FIG. 10, the controller 60 causes the driving of the second fan 26 to start at the same time as the first switching action for switching the rotational direction of the first fan 25 from the first direction to the second direction. Then, the controller 60 continues to drive the second fan 26 during a period (that is, the predetermined period T1) in which the above process of actions P1 is repeated. Accordingly, the predetermined period T1 may also be referred to as a period during which the second fan 26 is continuously driven. During the predetermined period T1, the second fan 26 is continuously driven to rotate in the second direction. Moreover, the controller 60 stops the driving of the second fan 26 at the same time as the second switching action for switching the rotational direction of the first fan 25 from the second direction to the first direction.

In this manner, during the predetermined period T1, even when the air capacity of the first fan 25 rotating in the second direction is insufficient, this air capacity insufficiency can be compensated by the air capacity of the second fan 26 due to the continuous driving the second fan 26 during the predetermined period T1 in which the process of actions P1 is repeated. For example, when the first fan 25 is rotated in the second direction at the minimum speed, the air capacity of the first fan 25 insufficient to blow away dusts can be compensated for by the air capacity of the second fan 26 rotating in the second direction. Accordingly, during the predetermined period T1 for which the process of actions P1 is repeated, the air capacity sufficient for blowing away dusts can be continuously obtained.

In the present example shown in FIG. 10, the driving of the second fan 26 is started simultaneously with the first switching action. Alternatively, the driving of the second fan 26 may be started at a different time from the time for the first switching action. Specifically, the driving of the second fan 26 may be started before the first switching action. In this case, the second airflow FL2 can be generated by the second fan 26 prior to the first fan 25, so that dusts can be blown away quickly. Alternatively, the driving of the second fan 26 may be started after the first switching action.

In the present example, the driving of the second fan 26 is stopped simultaneously with the second switching action. Alternatively, the driving of the second fan 26 may be stopped at a different time from the time for the second switching action. Specifically, the driving of the second fan 26 may be stopped after the second switching action. In this case, the second fan 26 is still driven continuously for a while (that is, a predetermined time) after the second switching action, and then is stopped. Therefore, even if dusts blown away and flown in the air fall down, the ducts are blown away, thereby being kept from being deposited on the hood 9 again. Alternatively, the driving of the second fan 26 may be stopped before the second switching action.

In the example shown in FIG. 10, the rotation speed of the second fan 26 rotating in the second direction is constant during the predetermined period T1. Alternatively, the rotation speed of the second fan 26 rotating in the second direction may be increased or decreased. When increasing or decreasing the rotation speed of the second fan 26 rotating in the second direction, it is preferable to set the second fan 26 to be rotated at a high rotation speed when the first fan 25 is rotated at a low rotation speed, and to set the second fan 26 to be rotated at a low rotation speed when the first fan 25 is rotated at a high rotation speed. Therefore, the magnitude of the second airflow FL2 is kept constant during the predetermined period T1.

Figure 11:
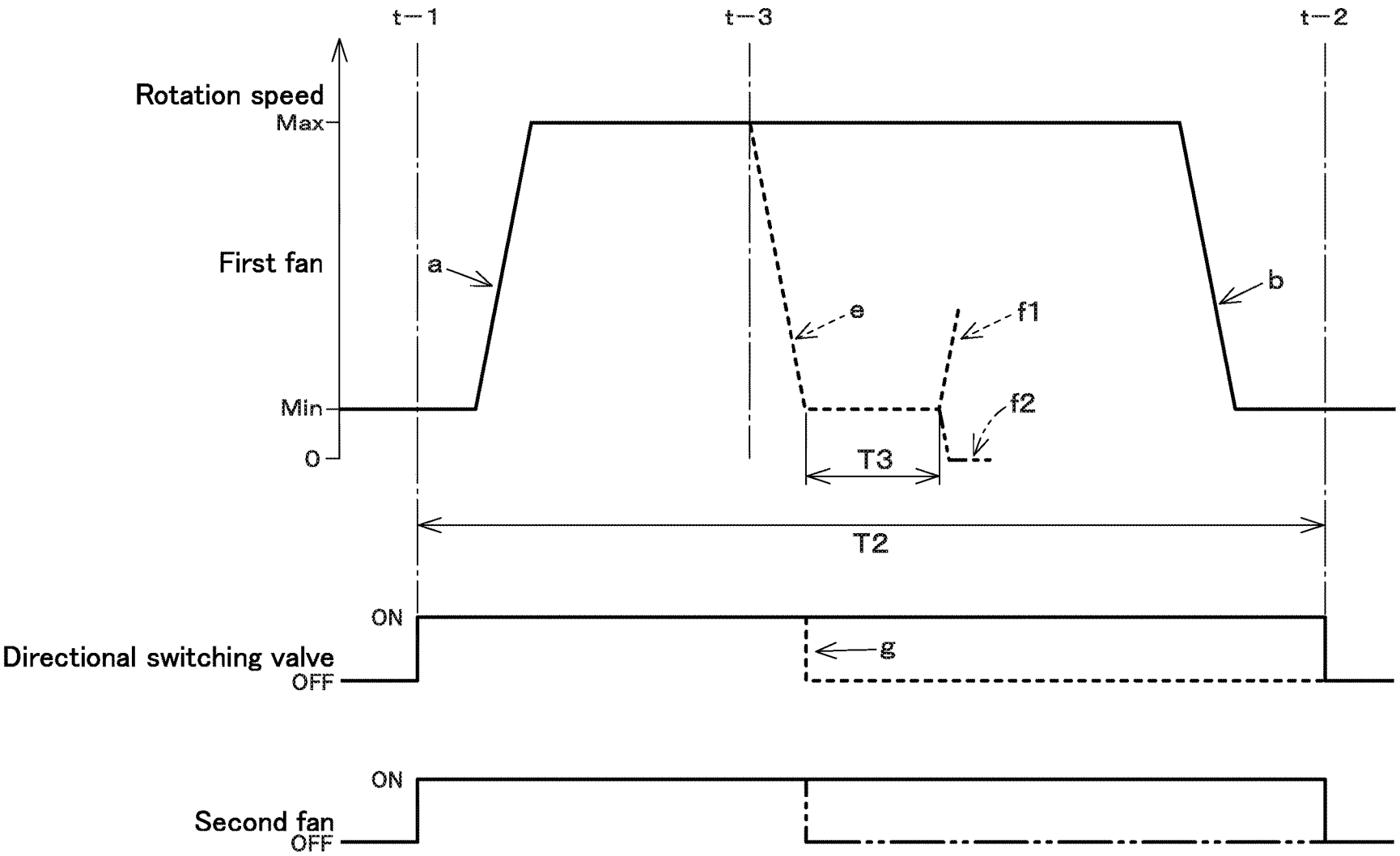
FIG. 11 is a view showing further another example of the action pattern of the first fan, the second fan, and the directional switching valve.

FIG. 11 illustrates another example of an action pattern of the first fan 25, the second fan 26, and the directional switching valve 73 controlled by the controller 60, and the horizontal axis represents an axis of time.

As shown in FIG. 11, the controller 60 is configured to cause the first fan 25 to perform a basic action (see solid lines) that starts the rotation in the second direction and ends it after passage of a predetermined time T2, and a canceling action (see dashed lines) that stops or interrupts the rotation of the first fan 25 in the second direction when an interruption condition is satisfied within the predetermined time T2.

First, control of the actions of the first fan 25 by the controller 60 will be described.

The basic action of the first fan 25 commanded by the controller 60 includes at least the action of starting the rotation in the second direction and the action of terminating the rotation after the elapse of a predetermined time from the starting. In addition to the action shown in the solid lines in FIG. 11, the basic action may include the action performed during the predetermined period T1 shown in FIG. 10 (that is, repetition of the process of actions P1 including the speed-increasing action a and the speed-reducing action b within the predetermined period T1), or may include any other action.

The following explanation is based on the case where the basic action is the action represented by the solid lines in FIG. 11. In this basic action, first, the first fan 25 is driven to rotate in the first direction at the minimum rotation speed. Next, the rotational direction of the first fan 25 is changed from the first direction to the second direction by switching the directional switching valve 73 when the first fan 25 is rotating at the minimum speed. Then, the speed-increasing action a is performed to increase a rotation speed of the first fan 25 in the second direction to the maximum rotation speed. And then, after continuing the rotation in the second direction at this maximum rotation speed, the speed-reducing action b is performed to decrease the rotation speed in the second direction. After the rotation speed of the first fan 25 in the second direction becomes the minimum speed, the rotational direction of the first fan 25 is changed from the second direction to the first direction by switching the directional switching valve 73, and the rotation in the second direction is terminated.

In this basic action, a time from a timing t-1 when the rotational direction of the first fan 25 is changed from the first direction to the second direction to a timing t-2 when the rotational direction of the first fan 25 is changed from the second direction to the first direction is defined as a predetermined time T2.

The controller 60 causes the canceling action to be executed to cancel the rotation of the first fan 25 in the second direction when the interruption condition is satisfied within the predetermined time T2. The canceling action is executed by transmitting a cancellation signal from the controller 60 to the control valve 70 to control the first fan 25. In FIG. 11, a cancellation signal is transmitted from the controller 60 at a timing t-3. The interruption condition will be described later.

The canceling action may be an operation to switch the rotational direction to the first direction after gradually decreasing the rotation speed of the first fan 25 in the second direction (hereinafter referred to as the "first canceling action"), or an operation to decrease the rotation speed of the first fan 25 in the second direction to the minimum rotation speed and then stop the rotation after a predetermined time has elapsed after (hereinafter referred to as the "second canceling action"). That is, there are two cases of "stopping the rotation of the first fan 25 in the second direction" to be executed by the canceling action: "a case where the rotational direction of the first fan 25 is switched from the second direction to the first direction" by the first canceling action and "a case where the rotation of the first fan 25 is stopped (the rotation speed becomes 0)" by the second canceling action.

Referring to FIG. 11, the first canceling action and the second canceling action will be described.

First, the case where the controller 60 causes the first fan 25 to perform the first canceling action will be described. In this case, when the controller 60 sends a cancellation signal to the control valve 70 at the timing t-3, a rotation speed of the first fan 25 in the second direction gradually decreases (see a part of an arrowed line e in FIG. 11). In detail, when the controller 60 sends the cancellation signal to the control valve 70 at the timing t-3, the current value to be supplied to the proportional valve 72 gradually increases and the opening degree of the proportional valve 72 gradually increases. In this manner, an amount of operation fluid to be supplied to the hydraulic motor for driving the first fan 25 gradually decreases, and thus a rotation speed of the first fan 25 in the second direction gradually decreases. After the rotation speed of the first fan 25 in the second direction becomes the minimum rotation speed, the directional switching valve 73 is switched from the ON state to the OFF state (see a part of an arrowed line g), and the rotational direction of the first fan 25 is changed from the second direction to the first direction. After that, the controller 60 continues the rotation of the first fan 25 in the first direction and increases the rotation speed of the first fan 25 in the first direction as needed (see a part of an arrowed line f1).

Next, a case where the controller 60 causes the first fan 25 to perform the second canceling action will be explained. In this case, when the controller 60 sends a cancellation signal to the control valve 70 at the timing T-3, the rotation speed of the first fan 25 in the second direction gradually decreases by the same action as that in the case of the first canceling action mentioned above (see the part of the arrowed line e in FIG. 11). The rotation speed of the first fan 25 in the second direction becomes the minimum rotation speed, and then the rotation of the first fan 25 in the second direction is stopped after a predetermined time T3 has elapsed (see a part of an arrowed line f2 in FIG. 11). In this case, the directional switching valve 73 is not switched from the ON state to the OFF state (the part of the arrowed line g), and the first fan 25 stops rotating by decreasing the rotation speed in the second direction. The rotation of the first fan 25 in the second direction can be stopped by opening the unloading valve 71. When opening the unloading valve 71, the supply of operation fluid to the hydraulic motor for driving the first fan 25 is stopped, thereby stopping the rotation of the first fan 25 in the second direction.

Next, control of the action of the second fan 26 by the controller 60 will be described.

As shown in FIG. 11, the controller 60 starts to drive the second fan 26 when the first fan 25 starts to rotate in the second direction. In addition, the controller 60 stops the driving of the second fan 26 when the first fan 25 terminates the rotation in the second direction. The second fan 26 continuously rotates in the second direction for the predetermined time T2 since the first fan 25 starts to rotate in the second direction until the first fan 25 terminates the rotation.

While the controller 60 controls the first fan 25 to execute the basic action, a driving pattern of the second fan 26 is a pattern shown by the solid lines in FIG. 11. In this case, after the rotation speed of the first fan 25 in the second direction becomes the minimum rotation speed, the second fan 26 stops driving at the same time as or after the switching of the directional switching valve 73.

When the controller 60 controls the first fan 25 to execute the canceling action, the driving pattern of the second fan 26 is a pattern shown by the virtual lines in FIG. 11. When the first canceling action is executed, the second fan 26 stops driving after the rotation speed of the first fan 25 in the second direction gradually decreases and becomes the minimum rotation speed.

An example of the interruption condition for execution of the above-described canceling action will be described below.

A first example of the interruption condition is that a temperature detected by the first sensor 61 or the second sensor 62 is out of a predetermined temperature range. The condition of "being out of a predetermined temperature range" means that the temperature exceeds the upper limit temperature in a predetermined temperature range or falls below the lower limit temperature in the predetermined temperature range. When the temperature detected by the first sensor 61 or the second sensor 62 is out of the predetermined temperature range, the controller 60 determines that the interruption condition has been satisfied and causes the first fan 25 to perform the canceling action. When the temperature detected by the first sensor 61 or the second sensor 62 is out of the predetermined temperature range, the controller 60 causes the first fan 25 to execute either the first canceling action or the second canceling action. Some cases can be predetermined as the interruption condition for determination of whether the first canceling action or the second canceling action should be executed. The cases predetermined as the interruption condition include a case where the temperature detected by the first sensor 61 exceeds the upper limit temperature of the predetermined temperature range, a case where the temperature detected by the first sensor 61 falls below the lower limit temperature of the predetermined temperature range, a case where the temperature detected by the second sensor 62 exceeds the upper limit temperature of the predetermined temperature range, and a case where the temperature detected by the second sensor 62 exceeds the upper limit temperature of the predetermined temperature range.

For example, when the temperature detected by the first sensor 61 or the second sensor 62 exceeds the upper limit temperature of the predetermined temperature range, the first canceling action changes the rotational direction of the first fan 25 from the second direction to the first direction, and thus the first fan 25 generates the first airflow FL1 for introducing the outside air into the machine body 2. As the result, the temperature of the operation fluid that activates the working device 4 or the temperature of the coolant that cools the engine 22 can be lowered, thereby preventing various devices in the working machine 1 from being overheated or suffering another problem.

For example, when the temperature detected by the first sensor 61 falls below the lower limit of the predetermined temperature range, the rotation of the first fan 25 can be stopped by the second canceling action to prevent an abnormal pressure rising and the like from occurring in the hydraulic circuit, and to prevent a surge pressure occurring in the hydraulic circuit from exceeding a specified pressure.

A second example of an interruption condition is that the engine 22 stops. In this case, the controller 60 determines that the interruption condition is satisfied when the engine 22 stops and controls the first fan 25 to perform the canceling action. When the engine 22 stops due to engine stalling or the like, the rotation of the first fan 25 is stopped by the second canceling action. In this case, the controller 60 decreases the rotation speed of the first fan 25 to the minimum speed and then stops the rotation of the first fan 25.

A third example of an interruption condition is that the switch 64 is switched to the OFF state. In this case, the controller 60 determines that the interruption condition is satisfied when the switch 64 is switched to the OFF state and controls the first fan 25 to perform the canceling action. In this manner, the rotation of the first fan 25 in the second direction can be interrupted by switching the switch 64 to the OFF state when some abnormality occurs in the working machine 1 or the like.

The canceling action according to this third example is performed, for example, when a person approaches the vicinity of the working machine 1 while the first fan 25 is rotated in the second direction. When the first fan 25 is rotated in the second direction, dusts on the hood 9 may be blown away and scattered toward the approaching person, but by switching the switch 64 to the OFF state and canceling the rotation of the first fan 25 in the second direction, the dusts can be prevented from being scattered toward the person.

The canceling action according to the third example can also be performed when the working machine 1 performs a heavy work requiring high horsepower by the working device 4. By switching the switch 64 to the OFF state and stopping the rotation of the first fan 25 when the working machine 1 performs the heavy work, it becomes easier to perform the heavy work with the working device 4.

A fourth example of an interruption condition is that a fault of a component related to the driving of the first fan 25 or the second fan 26 is detected by a detector. The detector is, for example, the disconnection detector 65 that detects a disconnection of a harness or a second fault detector that detects a fault of a control valve 70, but not limited thereto. One example as the fourth example is that a disconnection is detected by the disconnection detector 65. In this case, the controller 60 determines that the interruption condition is satisfied when the disconnection is detected by the disconnection detector, and controls the first fan 25 to execute the canceling action. This canceling action stops the rotation of the first fan 25, thereby preventing abnormal rotation of the first fan 25 caused by the disconnection. Another example of the fourth example is that the second fault detector detects a fault of the control valve 70 (such as a fault of a solenoid) that controls the rotation of the first fan 25. In this case, the controller 60 determines that the interruption condition is satisfied when the second fault detector detects the fault of the control valve 70 and controls the first fan 25 to perform the canceling action. This canceling action stops the rotation of the first fan 25, thereby preventing abnormal rotation of the first fan 25 caused by the fault of the control valve 70.

A fifth example of the interruption condition is that the filter regenerator that regenerates the filter of the exhaust gas purification device 23 is performing a filter regeneration process that burns particulate matters. In this case, the controller 60 determines that the interruption condition is satisfied when the filter regeneration processing unit is performing the filter regeneration process to burn particulate matters, and controls the first fan 25 to perform the canceling action. This canceling action can prevent the high-temperature air from being discharged to the outside of the machine body 2 by changing the rotational direction of the first fan 25 from the second direction to the first direction. In addition, since the first fan 25 generates the first airflow FL1 that introduces the outside air into the inside of the machine body 2, the temperature inside the machine body 2 can be lowered.

A sixth example of the interruption condition is that a difference value (that is, a dropping rotation speed) obtained by subtracting an actual rotation speed, which is a rotation speed detected by the rotation speed sensor 63, from a target rotation speed, which is a rotation speed set by the accelerator (that is, a setting member) 66, exceeds a predetermined threshold. In this case, the controller 60 determines that the interruption condition is satisfied when the dropping rotation speed becomes equal to or higher than the threshold value (that is, when a large engine dropping occurs) and controls the first fan 25 to perform the canceling action. This canceling action stops the rotation of the first fan 25, thereby preventing the engine stalling.

A seventh example of the interruption condition is that either one of the respective fault detectors provided in the first sensor 61 and the second sensor 62 detects a fault of the first sensor 61 or the second sensor 62. In this case, the controller 60 determines that the interruption condition is satisfied when the fault detector detects a fault of the corresponding sensor and controls the first fan 25 to perform the canceling action. By changing the rotational direction of the first fan 25 from the second direction to the first direction or by interrupting the rotation of the first fan 25, it is possible to prevent the fault of the first sensor 61 or the second sensor 62 from excessively increasing a temperature of the operation fluid or coolant or from causing the abnormal pressure rising in the hydraulic circuit.

An eighth example of the interruption condition is that the air conditioner is driven. In this case, the controller 60 determines that the interruption condition is satisfied when the air conditioner is driven, and controls the first fan 25 to perform the canceling action. By stopping the rotation of the first fan 25 by the canceling action, it becomes easier to perform a work when the working machine 1 performs a heavy work, for example.

The above-described interruption conditions are examples, and the interruption conditions are not limited to the above-described conditions. For example, it may be configured to execute the canceling action under a condition, as the interruption condition, where the temperature detected by an outside temperature sensor is out of the predetermined temperature range. The above-mentioned combination of each interruption condition and the canceling action associated with the satisfying of the interruption condition is also an example, and other combinations (for example, for some of the above-mentioned interruption conditions, the second canceling action is executed instead of the first canceling action, the first canceling action is executed instead of the second canceling action, or the like) may be adopted as necessary.

The control method described above based on FIGS. 10 and 11 is suitably used when the first fan 25 is a fan arranged on one directional surface side (that is, the lower surface side) of the radiator 24 and the second fan 26 is a fan arranged on the other directional surface side (that is, the upper surface side) of the radiator 24 (see FIGS. 1 and 3), but the first fan 25 may be a fan arranged on the above-mentioned other directional surface side (that is, the upper surface side) of the radiator 24, and the second fan 26 may be a fan arranged on the above-mentioned one directional surface side (that is, the lower surface side) of the radiator 24.

For example, in the control method described based on FIG. 10, the controller 60 can cause one or both of (at least one of) the fan arranged on one directional surface side (that is, the lower surface side) of the radiator 24 and the fan arranged on the other directional surface side (that is, the upper surface side) of the radiator 24 to perform the above process of actions P1. During the predetermined period T1 in which the process of actions P1 is repeated for either one of the fans, it is also possible to continuously control the driving (that is, the rotation in the second direction) of the other fan.

The control method described based on FIG. 10 and FIG. 11 is suitably used in a case where the first fan 25 is a hydraulic fan and the second fan 26 is an electric fan, but the first fan 25 may be an electric fan and the second fan 26 may be a hydraulic fan. In addition, both the first fan 25 and the second fan 26 may be hydraulic or electric fans.

In the above embodiment, one directional surface side of the radiator 24 is referred to as the lower surface side and the other directional surface side of the radiator 24 is referred to as the upper surface side, but it may be read that one directional surface side of the radiator 24 is the upper surface side and the other directional surface side of the radiator 24 is the lower surface side.

The working machine 1 includes the machine body 2, the engine 22 provided on the machine body 2, the radiator 24 to cool a coolant supplied to the engine 22, the first fan 25 provided on one directional surface side of the radiator 24, the first fan 25 being rotatable in either one of the first direction to suck external air to an interior of the machine body 2 and the second direction to generate an air flow for discharging air from the interior of the machine body 2 to an exterior of the machine body 2, and the second fan 26 provided on the other directional surface side of the radiator 24 and configured to be rotated in the second direction.

According to this configuration, the air capacity of the second fan 26 rotating in the second direction can compensate for the insufficient air capacity of only the first fan 25 rotating in the second direction (for example, the air capacity that is insufficient in the vicinity of the center (near the rotation shaft) of the first fan 25), so that the air capacity sufficient for blowing dusts toward the outside of the machine body 2 can be obtained.

The working machine 1 includes the controller 60 to control drive of the first fan 25 and the second fan 26. The controller 60 is configured or programmed to stop the second fan 26 when the first fan 25 rotates in the first direction, and to drive the second fan 26 when the first fan 25 rotates in the second direction.

According to this configuration, when the drive of the second fan 26 is stopped while the first fan 25 is rotating in the first direction, the second fan 26 does not obstruct the airflow generated by the rotation of the first fan 25 in the first direction. In addition, when the second fan 26 is driven while the first fan 25 is rotating in the second direction, the second fan 26 can compensate for the insufficient air capacity of only the first fan 25 rotating in the second direction.

The working machine 1 includes the condenser 27 to condense a refrigerant for the air conditioner provided on the machine body 2. The condenser 27 is provided between the radiator 24 and the second fan 26.

According to this configuration, the radiator 24 and the condenser 27 can be cooled by the airflow generated by the rotation of the first fan 25 in the first direction. In addition, the airflow generated by the rotation of the first fan 25 and the second fan 26 in the second direction can blow away dusts adhering to the radiator 24 and the condenser 27.

The air capacity of the first fan 25 rotating in the first direction is larger than that of the first fan 25 rotating in the second direction.

According to this configuration, when the first fan 25 is rotated in the first direction, the air capacity of the first fan 25 alone can sufficiently provide a cooling effect. When the first fan 25 is rotated in the second direction, the second fan 26 also rotates in the second direction, so that the air capacity for blowing away dusts does not become insufficient. Accordingly, both the cooling effect of the radiator 24 and the like and the effect of blowing away the dusts can be obtained reliably.

The first fan 25 and the second fan 26 have respective rotary axes coaxial to each other.

According to this configuration, when the first fan 25 and the second fan 26 are rotated in the second direction, the airflow generated by the rotation of the first fan 25 and the airflow generated by the rotation of the second fan 26 are joined together, so that sufficient airflow can be obtained to blow away the dusts.

The second fan 26 is diametrically smaller than the first fan 25.

According to this configuration, a larger air capacity portion of the second fan 26 (i.e., the outer peripheral portion of the second fan 26 and its vicinity) can be disposed in correspondence to a smaller air capacity of the first fan 25 (i.e., the central portion of the first fan 25 and its vicinity), so that dusts that cannot be blown away only by rotation of the first fan 25 can be surely blown away due to the rotation of the second fan.

The first fan 25 is a hydraulic fan driven by hydraulic pressure. The second fan 26 is an electric fan driven by electricity.

According to this configuration, the first fan 25, which is driven for cooling over a long period of time, employs a hydraulic fan, and the second fan 26, which is driven only when blowing away dusts, employs an electric fan. In this manner, the capacity of a battery mounted on the working machine 1 can be reduced.

The working machine 1 includes the fan cover 40 to cover an upper side of the second fan 26 opposite to the condenser 27. The second fan 26 is provided on a lower side thereof with the blade (the second blade 31), and on an upper side thereof with the motor (the second motor 30) for rotating the blade. An upper surface of the fan cover 40 includes the flat surface (the first flat surface 41*g*) and the uneven surface (the first uneven surface 41*h*). The flat surface (the first flat surface 41*g*) overlaps the motor (the second motor 30) in plan view.

According to this configuration, the fan cover 40 has an uneven surface (the first uneven surface 41*h*), which increases the surface area of the fan cover 40 to improve the heat radiation effect, improves the strength of the fan cover 40, and also prevents dusts from depositing over the entire upper surface of the fan cover 40. In addition, since the flat surface (the first flat surface 41*g*) is arranged at a position where the flat surface overlaps the motor (the second motor 30) in plan view, interference between the second motor 30 and the fan cover 40 can be prevented, and the height of the upper surface of the fan cover 40 can be lowered compared to the case where the first uneven surface 41*h* is arranged above the second motor 30. Accordingly, a rear view of the operator can be prevented from being blocked by the fan cover 40.

The working machine 1 includes the machine body 2, the engine 22 provided on the machine body 2, the radiator 24 to cool a coolant supplied to the engine 22, the first fan 25 provided on one directional surface side of the radiator 24, the first fan 25 being rotatable in either one of the first direction to suck external air to an interior of the machine body 2 and the second direction to generate an air flow for discharging air from the interior of the machine body 2 to an exterior of the machine body 2, and the controller 60 to control drive of the first fan 25. The controller 60 is configured or programmed to control drive of the first fan 25 rotating in the second direction in such a way that a process of actions including the speed-increasing action to increase a rotation speed of the first fan 25 and the speed-reducing action to reduce the rotation speed of the first fan 25 increased by the speed-increasing action is repeated in a predetermined period.

According to this configuration, by repeating the increase and decrease of the rotation speed when the first fan 25 is rotating in the second direction, a negative pressure (the suction pressure) is prevented from being generated in a part (on the hood) from which the wind blows out by rotation of the first fan 25 in the second direction. Accordingly, dusts can be blown away reliably for a long time.

The controller 60 is configured or programmed to increase the rotation speed of the first fan 25 rotating in the second direction to the maximum rotation speed during the speed-increasing action, and to reduce the rotation speed of the first fan 25 rotating in the second direction to the minimum rotation speed during the speed-reducing action.

According to this configuration, generation of the negative pressure described above can be prevented more reliably, and the dusts can be blown away reliably by the power of the air capacity that increases greatly in accordance with the increase of the rotation speed from the minimum rotation speed to the maximum rotation speed.

The controller 60 is configured or programmed to control drive of the first fan 25 rotating in the second direction during the process of actions P1 in such a way that the time Tc for the rotation of the first fan 25 at the maximum rotation speed is longer than the time Td for the rotation of the first fan 25 at the minimum rotation speed (Tc>Td).

According to this configuration, the time Tc during which the first fan 25 rotates at the maximum rotation speed in the second direction becomes longer, so that a longer time can be obtained during which the air capacity of the airflow in the direction of blowing away the dusts is large, and the dusts can be blown away more reliably.

The working machine 1 includes the second fan 26 provided on the other directional surface side of the radiator 24 and configured to be rotated in the second direction. The controller 60 is configured or programed to drive the second fan 26 continuously during the predetermined period T1 of repeating the process of actions P1.

According to this configuration, the second fan 26 is continuously driven during the predetermined period T1 in which the process of actions P1 is repeated, thereby ensuring enough airflow for blowing dusts continuously during the predetermined period T1 (even when the first fan 25 is rotating at the minimum speed).

The controller 60 is configured or programed to perform the first switching action to switch the rotation direction of the first fan 25 from the first direction to the second direction before start of repeating the process of actions P1, and to perform the second switching action to switch the rotation direction of the first fan 25 from the second direction to the first direction after end of repeating the process of actions P1.

According to this configuration, since the first fan 25 can be rotated in the first direction before and after the repetition of the process of actions P1, the cooling effect of the radiator 24 and the like can be surely obtained.

The controller 60 is configured or programed to perform the first switching action and the second switching action when the first fan 25 rotates at the minimum rotation speed.

According to this configuration, the switching of the rotational direction of the first fan 25 from the first direction to the second direction and the switching from the second direction to the first direction can be smoothly performed.

The controller 60 is configured or programed to start drive of the second fan 26 at the same time as the first switching action.

According to this configuration, since the second fan 26 starts rotating in the second direction at the same time as the first fan 25 is switched to the second direction, an air capacity sufficient for blowing dusts can be obtained quickly.

The controller 60 is configured or programed to stop drive of the second fan 26 at the same time as the second switching action.

According to this configuration, since the second fan 26 stops rotating in the second direction at the same time as the first fan 25 is switched to the first direction, the effect of the airflow (the cooling effect) produced by the rotation of the first fan 25 in the first direction can be prevented from being reduced by the airflow generated by the rotation of the second fan 26.

The controller 60 is configured or programed to stop drive of the second fan 26 after performing the second switching action.

According to this configuration, instead of stopping the second fan 26 at the same time as the second switching action, the second fan 26 is driven for a while after the second switching action and then stopped, thereby preventing the blown dusts from falling and being deposited on the hood or the like again.

The working machine 1 includes the machine body 2, the engine 22 provided on the machine body 2, the radiator 24 to cool a coolant supplied to the engine 22, the fan (the first fan) 25 provided on one directional surface side of the radiator 24, the first fan 25 being rotatable in either one of the first direction to suck external air to an interior of the machine body 2 and the second direction to generate an air flow for discharging air from the interior of the machine body 2 to an exterior of the machine body 2, and the controller 60 to control drive of the fan 25. The controller 60 is configured or programmed to make the fan 25 selectively perform either the basic action to finish the rotation of the fan in the second direction after the predetermined period T2 elapses from start of the rotation of the fan 25 in the second direction or the canceling action to interrupt the rotation of the fan 25 in the second direction when the interruption condition is satisfied in the predetermined period T2.

According to this configuration, while the fan 25 for cooling the radiator 24 or the like is being rotated in the reverse direction (the second direction) from the direction in the cooling, the rotation in the reverse direction can be interrupted as needed. In detail, when the interruption condition, under which the rotation in the reverse direction should be stopped, is satisfied during the execution of the basic action in which the fan 25 is rotating in the reverse direction, the rotation in the reverse direction can be stopped. This can avoid problems (such as overheating of the equipment) that may occur due to continuation of rotation of the fan 25 in the reverse direction.

The controller 60 is configured or programed to make the fan 25 perform the canceling action in such a way that the rotation direction of the fan 25 is switched to the first direction after the rotation speed of the fan 25 rotating in the second direction is gradually reduced.

According to this configuration, by gradually reducing the rotation speed of the rotation in the second direction, noise and increase in the surge pressure generated in the hydraulic circuit for supplying the operation fluid to the first fan 25 can be prevented. In addition, a cooling effect can be obtained by the rotation of the fan 25 in the first direction after the canceling action.

The controller 60 is configured or programed to make the fan 25 perform the canceling action in such a way that the rotation of the fan 25 is stopped after the rotation speed of the fan 25 rotating in the second direction is gradually reduced.

According to this configuration, by gradually reducing the rotation speed of the rotation in the second direction, noise and increase in the surge pressure generated in the hydraulic circuit for supplying the operation fluid to the first fan 25 can be prevented. In addition, by stopping the fan 25 after the canceling action, abnormal rotation of the fan 25 and the like can be prevented.

The controller 60 is configured or programed to make the fan 25 perform the canceling action in such a way that the rotation of the fan 25 is stopped after the predetermined period T3 elapses since the reduced rotation speed of the fan 25 rotating in the second direction becomes the minimum rotation speed.

According to this configuration, the fan 25 can be safely stopped when, for example, engine stoppage as an interruption condition occurs.

The working machine 1 further includes the working device 4 attached to the machine body 2, the first sensor 61 to detect a temperature of operation fluid for driving the working device 4, and the second sensor 62 to detect a temperature of the coolant for cooling the engine 22. The controller 60 is configured or programed to define a state where the temperature detected by the first sensor 61 or the second sensor 62 deviates from a predetermined temperature range as the satisfied interruption condition for determination to perform the canceling action.

According to this configuration, overheating and the like of equipment mounted on the working machine 1 can be prevented. In addition, the configuration can prevent abnormal pressure rising and the like occurring in the hydraulic circuit, and can prevent a surge pressure occurring in the hydraulic circuit from exceeding a specified pressure or the like.

The controller 60 is configured or programmed to define stopping of the engine 22 as the satisfied interruption condition for determination to perform the canceling action.

According to this configuration, when the engine 22 is stopped, the rotation of the fan 25 can be stopped by the canceling action.

The working machine 1 includes the switch 64 manually operable to be shifted between the ON state to allow the fan 25 to rotate in the second direction and the OFF state to hinder the fan 25 from rotating in the second direction. The controller 60 is configured or programmed to define the setting of the switch 64 in the OFF state as the satisfied interruption condition for determination to perform the canceling action.

According to this configuration, when a person approaches the vicinity of the working machine 1 while the fan 25 is being rotated in the second direction, the switch 64 is switched to the OFF state and the canceling action is executed, thereby preventing dusts from being scattered toward the person. In addition, in a case where the working machine 1 performs heavy work with the work device 4, the switching of the changeover switch 64 to the OFF state and executing of the canceling operation make it easier to perform heavy work with the work device 4.

The working machine 1 includes the detector (the disconnection detector 65, the second fault detector, and the like) to detect a fault of a component relevant to the drive of the fan 25. The controller 60 is configured or programmed to define a state where a fault is detected by the detector as the satisfied interruption condition for determination to perform the canceling action.

According to this configuration, abnormal rotation of the fan 25 caused by a fault of the component can be prevented by executing the canceling action and stopping the rotation of the fan 25 when the fault of the component related to the driving of the fan 25 is detected by the detector.

The working machine 1 includes the exhaust gas purificator 23 including the filter to trap particulate matters included in exhaust gas from the engine 22, and the filter regenerator to burn the particulate matters trapped by the filter. The controller 60 is configured or programed to define a state where the filter regenerator performs the filter regeneration process to burn the particulate matters as the satisfied interruption condition for determination to perform the canceling action.

According to this configuration, the execution of the canceling action can prevent high-temperature air from being discharged to the outside of the machine body 2 by changing the rotational direction of the fan 25 from the second direction to the first direction. In addition, the temperature inside the machine body 2 can be lowered because an airflow that introduces the outside air is generated inside the machine body 2.

The working machine 1 includes the setting member (the accelerator 66) to set a rotation speed of the engine 22, and the rotation speed sensor 63 to detect the rotation speed of the engine 22. The controller 60 is configured or programed to define a state where a differential value obtained by subtracting an actual rotation speed detected by the rotation speed sensor 63 from an instructed rotation speed set by the setting member (the accelerator 66) as the satisfied interruption condition for determination to perform the canceling action.

According to this configuration, when executing the canceling action, the engine stalling can be prevented by stopping the rotation of the fan 25.

The working machine includes the working device 4 attached to the machine body 2, the first sensor 61 to detect a temperature of operation fluid for driving the working device 4, the second sensor 62 to detect a temperature of the coolant for cooling the engine 22, and the fault detector to detect a fault of the first sensor 61 or the second sensor 62. The controller 60 is configured or programed to define a state where a fault is detected by the fault detector as the satisfied interruption condition for determination to perform the canceling action.

According to this configuration, by executing the canceling action, the rotational direction of the fan 25 is changed from the second direction to the first direction, or the rotation of the fan 25 is stopped, so that temperature of the operation fluid or coolant can be prevented from rising excessively due to a fault of the first sensor 61 or the second sensor 62, and an abnormal pressure rising can be prevented from occurring in the hydraulic circuit due to a fault of the first sensor 61 or the second sensor 62.

The working machine 1 includes the cabin 3 mounted on the machine body 2, and the air conditioner to feed a temperature-adjusted air into the cabin 3. The controller 60 is configured or programed to define a state where the air conditioner is driven as the satisfied interruption condition for determination to perform the canceling action.

According to this configuration, by stopping the rotation of the fan 25 by executing the canceling action, it becomes easier to perform work when the working machine 1 performs a heavy work, for example.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body;

an engine provided on the machine body;

a radiator to cool a coolant supplied to the engine;

a first fan provided on one directional surface side of the radiator, the first fan being rotatable in either one of a first direction to generate an air flow for sucking external air to an interior of the machine body and a second direction to generate an air flow for discharging air from the interior of the machine body to an exterior of the machine body;

a second fan provided on the other directional surface side of the radiator and configured to be rotated in the second direction; and a controller to control drive of the first and second fans, wherein a direction of the air flow generated by the first fan rotating in the second direction and a direction of an air flow generated by the second fan rotating in the second direction are the same, and the controller is configured or programmed:

to stop the second fan when the first fan rotates in the first direction; and to drive the second fan to rotate in the second direction when the first fan rotates in the second direction to cause the first fan and the second fan to generate the air flows in the same direction.

2. The working machine according to claim 1, further comprising:

a condenser to condense a refrigerant for an air conditioner provided on the machine body, wherein the condenser is provided between the radiator and the second fan.

3. The working machine according to claim 1, wherein the air capacity of the first fan rotating in the first direction is larger than that of the first fan rotating in the second direction.

4. The working machine according to claim 1, wherein the first fan and the second fan have respective rotary axes coaxial to each other.

5. The working machine according to claim 4, wherein the second fan is diametrically smaller than the first fan.

6. The working machine according to claim 1, wherein the first fan is a hydraulic fan driven by hydraulic pressure, and the second fan is an electric fan driven by electricity.

7. A working machine comprising:

a machine body;

an engine provided on the machine body;

a radiator to cool a coolant supplied to the engine;

a first fan provided on one directional surface side of the radiator, the first fan being rotatable in either one of a first direction to generate an air flow for sucking external air to an interior of the machine body and a second direction to generate an air flow for discharging air from the interior of the machine body to an exterior of the machine body; and a controller to control drive of the first fan, wherein the controller is configured or programmed to control drive of the first fan rotating in the second direction in such a way that a process of actions including a speed-increasing action to increase a rotation speed of the first fan and a speed-reducing action to reduce the rotation speed of the first fan increased by the speed-increasing action is repeated in a predetermined period, the controller is configured or programed:

to perform a first switching action to switch the rotation direction of the first fan from the first direction to the second direction before start of repeating the process of actions; and to perform a second switching action to switch the rotation direction of the first fan from the second direction to the first direction after end of repeating the process of actions, and the first fan does not rotate in the first direction during the predetermined period in which the process of actions is repeated.

8. The working machine according to claim 7, wherein the controller is configured or programmed:

to increase the rotation speed of the first fan rotating in the second direction to a maximum rotation speed during the speed-increasing action; and to reduce the rotation speed of the first fan rotating in the second direction to a minimum rotation speed during the speed-reducing action.

9. The working machine according to claim 8, wherein the controller is configured or programmed to control drive of the first fan rotating in the second direction during the process of actions in such a way that a time for the rotation of the first fan at the maximum rotation speed is longer than a time for the rotation of the first fan at the minimum rotation speed.

10. The working machine according to claim 8, wherein the controller is configured or programmed to control drive of the first fan rotating in the second direction during the process of actions in such a way that a time for the rotation of the first fan at the minimum rotation speed is longer than a time for the rotation of the first fan at the maximum rotation speed.

11. The working machine according to claim 7, further comprising:

a second fan provided on the other directional surface side of the radiator and configured to be rotated in the second direction, wherein the controller is configured or programed to drive the second fan continuously during the predetermined period of repeating the process of actions.

12. A working machine comprising:

a machine body;

an engine provided on the machine body;

a radiator to cool a coolant supplied to the engine;

a fan provided on one directional surface side of the radiator, the fan being rotatable in either one of a first direction to generate an air flow for sucking external air to an interior of the machine body and a second direction to generate an air flow for discharging air from the interior of the machine body to an exterior of the machine body; and a controller to control drive of the fan;

a working device attached to the machine body;

a first sensor to detect a temperature of operation fluid for driving the working device; and a second sensor to detect a temperature of the coolant for cooling the engine, wherein the controller is configured or programmed to:

make the fan selectively perform either a basic action to finish the rotation of the fan in the second direction after a predetermined period elapses from start of the rotation of the fan in the second direction or a canceling action to interrupt the rotation of the fan in the second direction when an interruption condition is satisfied in the predetermined period, and define a state where the temperature detected by the first sensor or the second sensor deviates from a predetermined temperature range as the satisfied interruption condition for determination to perform the canceling action.

13. The working machine according to claim 12, wherein the controller is configured or programed to make the fan perform the canceling action in such a way that the rotation direction of the fan is switched to the first direction after the rotation speed of the fan rotating in the second direction is gradually reduced.

14. The working machine according to claim 12, wherein the controller is configured or programed to make the fan perform the canceling action in such a way that the rotation of the fan is stopped after the rotation speed of the fan rotating in the second direction is gradually reduced.

15. The working machine according to claim 14, wherein the controller is configured or programed to make the fan perform the canceling action in such a way that the rotation of the fan is stopped after a predetermined period elapses since the reduced rotation speed of the fan rotating in the second direction becomes a minimum rotation speed.

16. The working machine according to claim 12, wherein the controller is configured or programmed to define stopping of the engine as the satisfied interruption condition for determination to perform the canceling action.

17. The working machine according to claim 12, further comprising:

a switch manually operable to be shifted between an ON state to allow the fan to rotate in the second direction and an OFF state to hinder the fan from rotating in the second direction, wherein the controller is configured or programmed to define the setting of the switch in the OFF state as the satisfied interruption condition for determination to perform the canceling action.

* * * * *